US009816196B2

(12) United States Patent
Spurlin et al.

(10) Patent No.: US 9,816,196 B2
(45) Date of Patent: Nov. 14, 2017

(54) METHOD AND APPARATUS FOR ELECTROPLATING SEMICONDUCTOR WAFER WHEN CONTROLLING CATIONS IN ELECTROLYTE

(71) Applicant: Novellus Systems, Inc., Fremont, CA (US)

(72) Inventors: Tighe A. Spurlin, Portland, OR (US); Charles L. Merrill, Portland, OR (US); Ludan Huang, Tigard, OR (US); Matthew Thorum, Tigard, OR (US); Lee Brogan, Tualatin, OR (US); James E. Duncan, Beaverton, OR (US); Frederick D. Wilmot, Gladstone, OR (US); Robert Marshall Stowell, Wilsonville, OR (US); Steven T. Mayer, Aurora, OR (US); Haiying Fu, Camas, WA (US); David W. Porter, Sherwood, OR (US); Shantinath Ghongadi, Tigard, OR (US); Jonathan D. Reid, Sherwood, OR (US); Hyosang S. Lee, Tigard, OR (US); Mark J. Willey, Portland, OR (US)

(73) Assignee: Novellus Systems, Inc., Fremont, CA (US)

( * ) Notice: Subject to any disclaimer, the term of this patent is extended or adjusted under 35 U.S.C. 154(b) by 448 days.

(21) Appl. No.: 13/869,891

(22) Filed: Apr. 24, 2013

(65) Prior Publication Data

US 2013/0284604 A1 Oct. 31, 2013

Related U.S. Application Data

(60) Provisional application No. 61/639,783, filed on Apr. 27, 2012, provisional application No. 61/666,390, filed on Jun. 29, 2012.

(51) Int. Cl.
*C25D 21/14* (2006.01)
*C25D 3/38* (2006.01)
(Continued)

(52) U.S. Cl.
CPC ..... *C25D 21/14* (2013.01); *C25D 3/38* (2013.01); *C25D 17/001* (2013.01);
(Continued)

(58) Field of Classification Search
CPC ..... C25D 3/38–3/40; C25D 21/18
See application file for complete search history.

(56) References Cited

U.S. PATENT DOCUMENTS 3,956,120 A 5/1976 Kardos et al.
4,555,135 A 11/1985 Freeland
(Continued)

FOREIGN PATENT DOCUMENTS

CN 1499992 A 5/2004
CN 1609281 A 4/2005
(Continued)

OTHER PUBLICATIONS

Frank and Bard, The Decomposition of the Sulfonate Additive Sulfopropyl Sulfonate in Acid Copper Electroplating Chemistries, 150(4) J. of the Electrochem. Society C244 (2003).*
(Continued)

*Primary Examiner* — Bryan D. Ripa
*Assistant Examiner* — Ho-Sung Chung
(74) *Attorney, Agent, or Firm* — Weaver Austin Villeneuve & Sampson LLP

(57) ABSTRACT

Apparatus and methods for electroplating metal onto substrates are disclosed. The electroplating apparatus comprise an electroplating cell and at least one oxidization device. The electroplating cell comprises a cathode chamber and an anode chamber separated by a porous barrier that allows
(Continued)

metal cations to pass through but prevents organic particles from crossing. The oxidation device (ODD) is configured to oxidize cations of the metal to be electroplated onto the substrate, which cations are present in the anolyte during electroplating. In some embodiments, the ODD is implemented as a carbon anode that removes Cu(I) from the anolyte electrochemically. In other embodiments, the ODD is implemented as an oxygenation device (OGD) or an impressed current cathodic protection anode (ICCP anode), both of which increase oxygen concentration in anolyte solutions. Methods for efficient electroplating are also disclosed.

19 Claims, 17 Drawing Sheets

(51) Int. Cl.
*C25D 21/18* (2006.01)
*C25D 17/00* (2006.01)
*C25D 21/12* (2006.01)

(52) U.S. Cl.
CPC ..... *C25D 17/002* (2013.01); *C25D 21/12* (2013.01); *C25D 21/18* (2013.01)

(56) References Cited

U.S. PATENT DOCUMENTS

| | | | | |
|---|---|---|---|---|
| 5,252,196 | A | 10/1993 | Sonnenberg et al. | |
| 6,113,769 | A | 9/2000 | Uzoh et al. | |
| 6,527,920 | B1 | 3/2003 | Mayer et al. | |
| 6,775,907 | B1 | 8/2004 | Boyko et al. | |
| 6,793,796 | B2 | 9/2004 | Reid et al. | |
| 6,821,407 | B1 | 11/2004 | Reid et al. | |
| 6,942,779 | B2 | 9/2005 | Belongia et al. | |
| 6,946,065 | B1 | 9/2005 | Mayer et al. | |
| 7,727,863 | B1 | 6/2010 | Buckalew et al. | |
| 7,776,741 | B2 | 8/2010 | Reid et al. | |
| 8,262,871 | B1 | 9/2012 | Mayer et al. | |
| 2002/0027080 | A1 | 3/2002 | Yoshioka et al. | |
| 2002/0112964 | A1 | 8/2002 | Gandikota et al. | |
| 2002/0130046 | A1 | 9/2002 | Cheung et al. | |
| 2003/0094376 | A1* | 5/2003 | Seita | C25D 3/38 205/291 |
| 2004/0000484 | A1 | 1/2004 | Sun et al. | |
| 2004/0060436 | A1 | 4/2004 | Parekh et al. | |
| 2004/0222100 | A1 | 11/2004 | Basol | |
| 2005/0164498 | A1* | 7/2005 | Ide | C25D 3/38 438/678 |
| 2005/0205429 | A1 | 9/2005 | Gebhart et al. | |
| 2006/0012044 | A1 | 1/2006 | Knop et al. | |
| 2006/0046481 | A1* | 3/2006 | Tokuda | H05K 3/187 438/687 |
| 2006/0084267 | A1 | 4/2006 | Kwak et al. | |
| 2006/0134902 | A1 | 6/2006 | Dubin et al. | |
| 2006/0151328 | A1 | 7/2006 | Reents et al. | |
| 2007/0125657 | A1 | 6/2007 | Sun et al. | |
| 2008/0090414 | A1* | 4/2008 | Chen | C23C 18/32 438/678 |
| 2009/0038952 | A1* | 2/2009 | Tachibana | C25D 3/38 205/296 |
| 2009/0229986 | A1* | 9/2009 | Omura | C25D 17/00 205/101 |
| 2010/0041226 | A1 | 2/2010 | Reid et al. | |
| 2010/0089758 | A1 | 4/2010 | Tomonaga et al. | |
| 2010/0300888 | A1 | 12/2010 | Ponnuswamy et al. | |
| 2010/0320081 | A1 | 12/2010 | Mayer et al. | |
| 2010/0320609 | A1 | 12/2010 | Mayer et al. | |
| 2011/0056840 | A1* | 3/2011 | Isono | C25D 21/04 205/296 |
| 2011/0226614 | A1 | 9/2011 | Rash et al. | |
| 2011/0297551 | A1 | 12/2011 | Morita et al. | |
| 2012/0064462 | A1 | 3/2012 | Willey et al. | |
| 2012/0175263 | A1 | 7/2012 | Ganesan et al. | |

FOREIGN PATENT DOCUMENTS

| | | | | | |
|---|---|---|---|---|---|
| CN | 1749442 | A | | 3/2006 | |
| CN | 101407935 | A | | 4/2009 | |
| CN | 101517131 | A | | 8/2009 | |
| JP | 2007169700 | A | | 7/2000 | |
| JP | 2004-143478 | A | | 5/2004 | |
| JP | 2006-111976 | A | | 4/2006 | |
| JP | 2009-149979 | A | * | 7/2009 | C25D 21/14 |
| TW | I255871 | B | | 6/2006 | |
| TW | 200636887 | A | | 10/2006 | |
| TW | I281516 | B | | 5/2007 | |
| WO | WO 02/062446 | | | 8/2002 | |

OTHER PUBLICATIONS

Kawakami et al., English Abstract and Machine Translation, JP 2009-149979 A (2009).*

U.S. Office Action dated Dec. 6, 2013 issued in U.S. Appl. No. 13/229,615.

U.S. Final Office Action dated Mar. 27, 2014 issued in U.S. Appl. No. 13/229,615.

U.S. Office Action dated Apr. 16, 2015 issued in U.S. Appl. No. 13/324,890.

U.S. Final Office Action dated Oct. 29, 2015 issued in U.S. Appl. No. 13/324,890.

Chinese First Office Action dated Mar. 19, 2015 issued in CN 201110281341.7.

Chinese First Office Action dated Jun. 17, 2015 issued in CN 201210005429.0.

Taiwanese Office Action dated Aug. 6, 2015 issued in TW 100149613.

Lee, Wen-Hsi et al. (2010) "Bis-(3-sodiumsulfopropyl disulfide) Decomposition with Cathodic Current Flowing in a Copper-Electroplating Bath," *J.Electrochem.Soc.*,157(1):H131-H135.

Reid, J.D. (1987) "An HPLC Study of Acid Copper Brightener Properties", *Printed Circuit Fabrication*, pp. 65-75.

Wang, Wei et al. (2009) "Invalidating mechanism of bis (3-sulfopropyl) disulfide (SPS) during copper via-filling process," *Applied Surface Science*, 255(8):4389-4392.

Zhou, Haixian (Jan. 31, 2010) "Micro-Opto-Electro-Mechanical Systems," *National Defense Industry Press*, 5pp.

Taiwanese Office Action dated Jun. 1, 2016 issued in TW 100149613.

Taiwanese Office Action dated Aug. 11, 2016 issued in TW 102115253.

U.S. Office Action dated Feb. 14, 2017 issued in U.S. Appl. No. 13/324,890.

U.S. Notice of Allowance dated Jul. 11, 2017 issued in U.S. Appl. No. 13/324,890.

* cited by examiner

METHOD AND APPARATUS FOR ELECTROPLATING SEMICONDUCTOR WAFER WHEN CONTROLLING CATIONS IN ELECTROLYTE

CROSS-REFERENCE TO RELATED APPLICATIONS

The present application claims the benefit of and priority to U.S. Provisional Patent Application No. 61/639,783, entitled "Apparatus for Oxygenation of Separated Anode Chambers," filed Apr. 27, 2012, and U.S. Provisional Patent Application No. 61/666,390, entitled "Electroplating Apparatus Including Auxiliary Electrodes," filed Jun. 29, 2012, which applications are fully incorporated herein by reference in their entirety.

BACKGROUND

Field of the Invention

This invention generally relates to electroplating metal layers onto substrates. More specifically, it relates to apparatus for controlling the composition, flow, and potential distribution of electrolyte while electroplating a wafer.

Related Technology

In electronics, a wafer (also called a slice or substrate) is a thin slice of semiconductor material, such as a silicon crystal, used in the fabrication of integrated circuits and other microdevices. The wafer serves as the substrate for microelectronic devices built in and over the wafer. The fabrication process of microelectronic devices involves many steps including, e.g., doping, electroplating, etching, and photolithographic patterning.

Electroplating uses electrical current to reduce dissolved metal cations so that they form a coherent metal coating on an electrode. This form of electroplating is widely used to deposit conductive metal on semiconductor wafer in the manufacture of microdevices. Electroplating can also oxidize anions onto a solid substrate, as in the formation of silver chloride on silver wire to make silver/silver-chloride electrodes.

In electroplating of metal cations onto a wafer, the wafer forms the cathode of the circuit. One form of electroplating involves an active anode (also known as a consumable anode), wherein the anode is made of the metal to be plated on the wafer. Both the anode and the wafer are immersed in a solution called an electrolyte containing one or more dissolved metal salts as well as other ions that permit the flow of electricity. A power supply provides a direct current to the anode, oxidizing the metal atoms that comprise it and allowing them to dissolve in the electrolyte. At the cathode, the dissolved metal ions in the electrolyte solution are reduced at the interface between the solution and the wafer cathode, such that they "plate out" onto the wafer. The rate at which the anode is dissolved is equal to the rate at which the cathode is plated. In this manner, reactions are balanced, and ions in the electrolyte bath are continuously replenished by the anode.

Other electroplating processes may use a non-reactive anode (also known as a non-consumable or dimensionally stable anode) comprising, e.g., lead or carbon. In these techniques, the anode does not provide cations for the plating. Instead, ions of the metal to be plated must be periodically replenished in the electrolyte as they are drawn out of the solution. The reactions in a non-consumable system are unbalanced. The two reactions are:

$$H_2O \rightarrow \tfrac{1}{2}O_2 + 2H^+ + 2e^- \text{ (anode)}$$

$$Cu^{+2} + 2e^- \rightarrow Cu \text{ (cathode).}$$

Needs exist for methods and apparatus for improving electroplating efficiency and quality by controlling the composition, flow, and potential distribution of electrolyte.

SUMMARY

Copper electroplating apparatus are known to benefit from separated anode and cathode chambers due to reduced organic additive degradation, minimized chemical waste generation, and improved plating solution stability/longevity. Enclosed anode/anolyte chambers result in anolyte solutions that have low dissolved oxygen content, which may generate conditions for the buildup of reactive copper species. The reactive copper species may impact organic additive degradation in the plating solution and the plating solution performance. Embodiments disclosed herein allow for the control of cuprous ion (Cu(I)) concentrations in the anolyte solution. Embodiments disclosed herein also allow for the control of the oxygen in anolyte solutions, which may substantially minimize and/or reduce cuprous ion (Cu(I)) buildup. Controlling the oxygen concentration in anolyte solutions may mitigate potential issues related to the impact that Cu(I) have on copper electroplating.

One innovative aspect of the subject matter described herein can be implemented in an electroplating apparatus including a carbon anode implemented as part of a membrane electrode assembly that can be used to remove Cu(I) from the anolyte electrochemically. Another aspect concerns controlling the oxygen concentration in anolyte solutions to mitigate potential issues related to the impact that Cu(I) has on copper electroplating. For example, an anolyte oxygenation device is described, which is intended to increase the dissolved oxygen content of the anolyte and prevent the formation of reactive copper species that can reduce the plating solution performance. An additional innovative aspect of the subject matter described herein can be implemented in an electroplating apparatus including an impressed current cathodic protection anode (ICCP anode) that can be used to counteract a corrosion reaction at the copper anode that produces Cu(I) and to maintain a relatively high dissolved oxygen concentration in the anolyte solution. Maintaining a sufficiently high dissolved oxygen concentration in the anolyte solution maintains the dissolved oxygen as the primary scavenger of Cu(I).

One aspect of the invention relates to apparatus for electroplating a metal onto a substrate such as a silicon wafer. In some embodiments, the apparatus includes an electroplating cell and at least one oxidation device (ODD). The electroplating cell include: (a) a cathode chamber for containing catholyte during electroplating; (b) a cathode electrical connection in the cathode chamber, the cathode electrical connection being able to connect to the substrate and apply a potential allowing the substrate to become a cathode; (c) an anode chamber for containing anolyte during electroplating; (d) an anode electrical connection in the anode chamber, the anode electrical connection being able to connect to an electroplating anode and apply a potential to the electroplating anode; (e) and a porous transport barrier placed between the anode chamber and the cathode chamber, which transport barrier enables migration of ionic species in an electrolyte, including metal cations, across the transport barrier while substantially preventing organic additives from passing across the transport barrier. The at least one oxidation device (ODD) is configured to oxidize cations of the metal to be electroplated onto the substrate, which cations are present in the anolyte during electroplating. In alternative embodiments, the cations to be oxidized are present only in the catholyte during electroplating.

In some embodiments, the metal to be electroplated onto the substrate is copper, and the anolyte comprises one or more copper salts dissolved in a solvent. In these embodiments, the oxidation device (ODD) oxidizes Cu(I) to Cu(II). In some embodiments, the catholyte contains a substantially greater concentration of the organic plating additives than the anolyte does.

In some embodiments, the porous transport barrier of the electroplating apparatus comprises a material selected from the group consisting of porous glasses, porous ceramics, silica aerogels, organic aerogels, porous polymeric materials, and filter membranes.

In some embodiments, the electroplating apparatus includes an anolyte re-circulation loop fluidically coupled to the electroplating cell. The anolyte circulation loop includes an anolyte storage reservoir connected to the anode chamber, and an anolyte recirculation pump that recirculates anolyte to the anode chamber. In some embodiments, the electroplating apparatus also includes a catholyte storage reservoir connected to the cathode chamber to provide catholyte to the cathode chamber.

In some embodiments, the at least one oxidation device (ODD) of the electroplating apparatus is an oxygenation device (OGD), a membrane electrode assembly (MEA), an impressed current cathodic protection anode (ICCP anode), or any combination thereof.

In some embodiments, the oxidation device (ODD) of the electroplating apparatus comprises an oxygenation device (OGD). The OGD is disposed in the anolyte re-circulation loop and it exposes the anolyte to oxygen. In some embodiments, the OGD is placed in line with the anolyte recirculation pump. In some embodiments, the OGD comprises a dwell tank fluidly coupled to the anode chamber. In some embodiments, the OGD comprises an oxygen sparging device disposed in the anolyte storage reservoir. In some embodiments, the OGD comprises a contractor or a membrane contractor. In some embodiments, the anolyte recirculation loop is configured to operate with a flow rate at about 0.25 liters per minute (lpm) to about 1 lpm. The source of oxygen for the OGD can be, for instance, atmospheric air, clean dry air, substantially pure oxygen.

In some embodiments, the electroplating apparatus includes an oxygen concentration meter that provides feedback for controlling oxygen concentration of the anolyte.

In some embodiments, the oxidation device (ODD) of the electroplating apparatus comprises a membrane electrode assembly (MEA) or an impressed current cathodic protection anode (ICCP anode) disposed in the electroplating cell. In some embodiments, the MEA comprises a carbon cloth on the side of the MEA facing the electroplating anode. The carbon cloth is electrically coupled to an electrical source for applying a bias relative to the electroplating anode. In some embodiments, the carbon cloth is biased at about 0.25 to 0.75 V higher than the copper anode. In some embodiments, the carbon cloth has a thickness of about 50 microns to 1 millimeter.

In some embodiments, the ODD of the electroplating apparatus is an ICCP anode, which comprises platinum. In some embodiments, when the ICCP anode is biased, it generates oxygen by electrolyzing water in the electrolyte.

In some embodiments that include an active anode as the electroplating anode, the ICCP anode, when biased, decreases the corrosion of the electroplating anode by reducing copper cations to copper at the electroplating anode.

Another aspect of the invention relates to methods for electroplating a metal onto a wafer substrate. In some embodiments, the method involves providing an anolyte in an anode chamber having an anode and being separated from a cathode chamber by a porous transport barrier that enables migration of ionic species, including metal cations, across the transport barrier while substantially blocking organic plating additives from diffusing across the transport barrier. The method also involves providing a catholyte to the cathode chamber containing the substrate attached to a cathode electrical connection, wherein the catholyte contains a substantially greater concentration of the organic plating additives than the anolyte. The method further includes oxidizing cations of the metal to be electroplated onto the substrate, which cations are present in the anolyte during electroplating. The method involves applying a potential difference between the substrate and the anode, thereby plating the metal onto the substrate without substantially increasing the concentration of plating additives in the anolyte.

In some embodiments, the metal to be electroplated onto the substrate is copper, and the anolyte comprises one or more copper salts dissolved in a solvent. The oxidation of metal cations is achieved by oxidizing Cu(I) to Cu(II). In some embodiments, oxidation of metal cations is achieved by maintaining the oxygen concentration of the anolyte at about 0.05 ppm to 9 ppm. In some embodiments, the oxygen concentration of the anolyte is maintained at about 0.5 ppm to 2 ppm.

In some embodiments, oxidation of the cations of the metal is achieved by: (a) removing the anolyte from the anode chamber; (b) treating the anolyte by allowing the anolyte to contact oxygen, thereby increasing the oxygen concentration of the anolyte; and (c) re-introducing the treated anolyte to the anode chamber.

In some embodiments, oxidation of the cations of the metal is achieved by biasing an impressed current cathodic protection anode (ICCP anode), thereby electrolyzing water in the anolyte to yield oxygen and/or reducing copper cations to copper at the anode to prevent corrosion of the anode. In some embodiments, biasing the ICCP anode comprises applying a current at about 1 $\mu A/cm^2$ to 100 $\mu A/cm^2$ to the ICCP anode for an electroplating process for a 300 mm substrate. In some embodiments, the current is at about 50 $\mu A/cm^2$.

In some embodiments, oxidation of cations of the metal is achieved by biasing a membrane electrode assembly (MEA) and contacting Cu(I) with the MEA, thereby oxidizing Cu(I) to Cu(II).

In some embodiments, the method involves maintaining the anolyte at a temperature of about 20° C. to 35° C. In some embodiments, the temperature is maintained at about 23° C. to 30° C.

These and other features of the disclosed embodiments will be described more fully in the following description with reference to the associated drawings.

BRIEF DESCRIPTION OF THE DRAWINGS

To further clarify various aspects of some embodiments of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION

Figure 1:
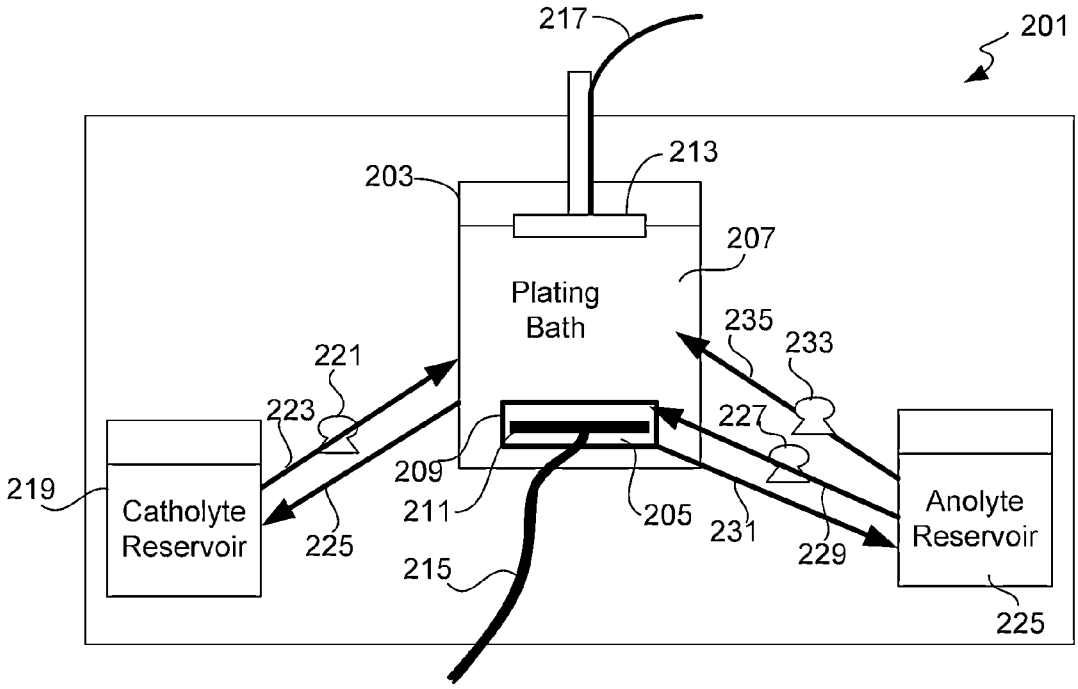
FIG. 1 illustrates an example of a block diagram of an electroplating apparatus.

In the following detailed description, numerous specific implementations are set forth in order to provide a thorough understanding of the disclosed implementations. However, as will be apparent to those of ordinary skill in the art, the disclosed implementations may be practiced without these specific details or by using alternate elements or processes. In other instances well-known processes, procedures, and components have not been described in detail so as not to unnecessarily obscure aspects of the disclosed implementations.

In this application, the terms "semiconductor wafer," "wafer," "substrate," "wafer substrate," and "partially fabricated integrated circuit" are used interchangeably. One of ordinary skill in the art would understand that the term "partially fabricated integrated circuit" can refer to a silicon wafer during any of many stages of integrated circuit fabrication thereon. The following detailed description assumes the disclosed implementations are implemented on a wafer substrate. However, the disclosed implementations are not so limited. The work piece may be of various shapes, sizes, and materials. In addition to semiconductor wafers, other work pieces that may take advantage of the disclosed implementations include various articles such as printed circuit boards and the like.

Generally, some embodiments described herein provide apparatus and methods for removing Cu(I) cations from the anolyte electrochemically. In some embodiments, an oxidation device removes Cu(I) cations by oxidation of Cu(I) to Cu(II). The embodiments described herein also provide apparatus and methods for counteracting a corrosion reaction at the copper anode and to maintain a high dissolved oxygen concentration in the anolyte solution, which maintains dissolved oxygen as the primary scavenger of Cu(I).

I. INTRODUCTION

Damascene processing is a method for forming metal lines on integrated circuits. It is often used because it requires fewer processing steps than other methods and offers a high yield. Conductive routes on the surface of an integrated circuit formed during Damascene processing are commonly filled with copper. The copper may be deposited in the conductive routes with an electroplating process in an electroplating apparatus, using a catholyte or plating solution.

Through-silicon-vias (TSVs) are sometimes used to create three-dimensional (3D) packages and 3D integrated circuits by providing interconnection of vertically aligned electronic devices through internal wiring. TSV structures are further described in U.S. Pat. No. 7,776,741, which is herein incorporated by reference.

In Damascene and TSV processing, additives may be included in a plating solution to enhance the electroplating process. Such additives include accelerators, suppressors, and levelers. Accelerators, alternatively termed brighteners, are additives which increase the rate of the plating reaction. Accelerators are molecules which adsorb on metal surfaces and increase the local current density at a given applied voltage. Accelerators may contain pendant sulfur atoms, which are understood to participate in the cupric reduction reaction and thus strongly influence the nucleation and surface growth of metal films. Accelerator additives are commonly derivatives of mercaptopropanesulfonic acid (MPS), dimercaptopropanesulfonic acid (DPS), or bis(3-sulfopropyl) disulfide (SPS), although other compounds can be used. Non-limiting examples of deposition accelerators include the following: 2-mercaptoethane-sulfonic acid (MESA), 3-mercapto-2-propane sulfonic acid (MPSA), dimercaptopropionylsulfonic acid (DMPSA), dimercaptoethane sulfonic acid (DMESA), 3-mercaptopropionic acid, mercaptopyruvate, 3-mercapto-2-butanol, and 1-thioglycerol. Some useful accelerators are described, for example, in U.S. Pat. No. 5,252,196, which is herein incorporated by reference. Accelerators are available commercially as Vertical A Accelerator from MLI (Moses Lake, Wash.) or as Extreme Accelerator from Enthone Inc. (West Haven, Conn.), for example. The plating solution may include about 100 parts per million (ppm) or less of an accelerator in Damascene processes. The plating solution may include about 10 ppm or less, or about 1-8 ppm, of an accelerator in TSV fabrication processes. Further description of Damascene processing and TSV fabrication processes can be found in U.S. patent application Ser. Nos. 13/324,890 and 13/229,615, both of which are herein incorporated by reference.

Suppressors, alternatively termed carriers, are polymers that tend to suppress current after they adsorb onto the metal surface. Suppressors may be derived from polyethylene glycol (PEG), polypropylene glycol (PPG), polyethylene oxide, or their derivatives or co-polymers. Commercial suppressors include Vertical A Suppressor from MLI (Moses Lake, Wash.) or Extreme Suppressor from Enthone Inc. (West Haven, Conn.), for example.

Levelers generally are cationic surfactants and dyes which suppress current at locations where their mass transfer rates are most rapid. The presence of levelers, therefore, in a plating solution serves to reduce the film growth rate at protruding surfaces or corners where the levelers are preferentially absorbed. Absorption differences of levelers due to differential mass transfer effects may have a significant effect. Some useful levelers are described in, for example, in U.S. Pat. Nos. 5,252,196, 4,555,135 and 3,956,120, each of which is incorporated herein by reference. Levelers are available commercially as Vertical A Leveler from MLI (Moses Lake, Wash.) or as Pura Leveler from Enthone Inc. (West Haven, Conn.), for example. Accelerators, suppressors, and levels are further described in U.S. Pat. No. 6,793,796, which is herein incorporated by reference.

Embodiments of electroplating apparatus that may prevent anode mediated degradation of plating solution additives include a mechanism for maintaining separate anolyte (i.e. the solution in contact with the anode) and catholyte (i.e., the solution in contact with the cathode, also referred to as the plating solution) and preventing mixing thereof within the electroplating apparatus. In some embodiments, the separation of the anolyte and catholyte is accomplished by interposing a porous cationic membrane transport barrier between an anode chamber and a cathode chamber. Such electroplating apparatus are described in U.S. Pat. Nos. 6,527,920, 6,821,407, and 8,262,871, which are herein incorporated by reference.

In some electroplating apparatus including a separate anode chamber and cathode chamber, it was found that the low dissolved oxygen environment in the anode chamber, which exists because of interactions between the anolyte and the phosphorus doped copper anode, can lead to cuprous cations Cu(I), a reactive copper species. See Reaction 1. If chloride ions are present, then a second reaction (see Reaction 2) can also occur in the anolyte, creating a Cu(I) chloride complex, which also may be reactive.

$$Cu+Cu^{2+} \leftrightarrow 2Cu^{+}$$ Reaction 1—copper comproportionation reaction $$Cu+Cu^{2+}+4Cl^{-} \leftrightarrow 2(CuCl_2)_{aq}^{-}.$$ Reaction 2—copper complexation reaction The buildup of these reactive copper species in the anode chamber can significantly impact the plating solution performance because Cu(I) can interact with organic additives within the plating solution when the anolyte is dosed into the cathode plating solution to maintain inorganic additive concentrations. That is, in normal operation, anolyte may be added to the plating solution or catholyte to maintain inorganic additive concentrations. Further, Cu(I) may also migrate across the cationic membrane separating the anode chamber and the cathode chamber and into the catholyte. In either case, dosing the anolyte into the catholyte or simple diffusion of Cu(I) across the cationic membrane will cause degradation of the organic additives in the catholyte.

Potential issues related to Cu(I) in the plating solution include, but are not limited to the following.

1. Cu(I) creates a variety of complexes with accelerator molecules that feature thiol functional groups and disulfide bonds, such as bis(sodiumsulfopropyl) disulfide (SPS). An example of a possible reaction that forms a Cu-accelerator complex is shown in Reaction 3. There are a number of different complexes that may form between Cu(I) and accelerator molecules.

$$4Cu^{+}+SPS \leftrightarrow 2Cu^{2+}+2Cu(I)\cdot MPS$$ Reaction 3—copper-accelerator formation 2. The formation of Cu(I)-accelerator complexes during an electroplating process is known to increase copper deposition rates through enhanced accelerator activity. Buildup of these complexes in a plating solution can lead to a slow/no fill rate in patterned features on a wafer substrate due to rapid depolarization of the plating solution-substrate interface, voids in features resulting from fill not occurring in a bottom-up fill mechanism, and/or increased defect counts associated with localized rapid nucleation of copper.

3. Cu(I)-accelerator complexes formed during electroplating processes are known to rapidly degrade into oxidized byproducts after exposure to oxygen in the cathode chamber. An example of a possible breakdown reaction is shown in Reaction 4. Accumulation of these byproducts in a plating solution can result in reduced fill rates, increased defect counts, and increased waste generation. In addition, breakdown of the accelerator molecules creates an added cost in electroplating processes as the organic additives may need to be more frequently replaced.

$$Cu(I)\text{–}MPS+O_2 \rightarrow Cu^{2+}+\text{Oxidized Byproducts}$$ Reaction 4—Accelerator breakdown 4. Cu(I) may also interact with other organic additives commonly used in copper electroplating processes, such as suppressor and leveler molecules.

5. The accumulation of Cu(I) itself in the plating solution can lead to changes in plating overpotential and current density, which could alter fill rate and plating performance.

II. APPARATUS

FIG. 1 shows an example of a block diagram of an electroplating apparatus 201. The electroplating apparatus is one example of an electroplating apparatus, and different configurations of electroplating apparatus may be used. An electroplating compartment 203 includes an anode chamber 205 and a cathode chamber 207. The anode chamber 205 is defined by an ion-pass chemical transport barrier 209 enclosing an anode 211. The chemical transport barrier 209 allows metal cations to pass through while preventing organic particles from crossing the barrier. It also may be referred to as an ionic membrane or a cationic membrane. In some embodiments, the transport barrier comprises a first layer of porous material sandwiched between two additional layers of porous material to provide a three-layer porous membrane, wherein the first layer is substantially thinner than the two additional layers. In some embodiments further described below, the transport barrier is coupled with a carbon cloth electrode to form a membrane electrode assembly (MEA) that can electrochemically oxidize Cu(I) cations to Cu(II) cations.

The anode chamber 205 includes an anolyte solution associated with the anode. The cathode chamber 207 forms, in this embodiment, the major chamber of the electroplating compartment 203. It contains a plating solution or catholyte associated with a cathode 213. In some embodiments, the cathode 213 is a semiconductor wafer or substrate having trenches etched on its surface for Damascene processing or vias etched on its surface for TSV processing. During an electroplating process, an electrical field is established between the anode 211 and the cathode 213. This electrical field drives positive ions from the anode chamber 205, through the barrier 209 and the cathode chamber 207, and onto the cathode 213. At the cathode 213, an electrochemical reaction takes place in which positive metal ions are reduced to form a solid layer of metal on the surface of the cathode 213. In some embodiments, the metal ions are copper ions and copper metal is deposited into the trenches on a semiconductor wafer, bottom-up. In some embodiments, the cathode/substrate rotates during electroplating.

The anode 211 may be made from a sacrificial metal such as copper. An anodic potential is applied to the anode 211 via an anode electrical connection 215. Typically this connection includes a lead formed from a corrosion resistant metal such as titanium or tantalum. Cathodic potentials are provided to the cathode 213 via a lead 217, which may also be made from a suitable metal. In some embodiments, other suitable materials for the electrodes can be substituted to perform the same functions.

As indicated above, a purpose of the porous membrane 209 is to maintain a separate chemical and/or physical environment in the anode chamber 205 and the cathode chamber 207. The membrane 209 should be designed or selected to largely prevent non-ionic organic species from entering the anode chamber 205. More specifically, organic additives should be kept out of the anode chamber 205.

The catholyte may be circulated between cathode chamber 207 and a catholyte reservoir 219. The temperature and composition of the catholyte may be controlled within the catholyte reservoir 219. For example, one can monitor and control the level of non-ionic plating additives within the reservoir 219. Gravity can enable the return of excess catholyte out of the cathode chamber 207 through a catholyte exit line 225 and into the catholyte reservoir 219. Treated catholyte from the reservoir 219 may then be directed back into the cathode chamber 207 by a pump 221 via a catholyte entry line 223.

The anolyte in anode chamber 205 may be stored in and replenished from an anolyte reservoir 225. In this example, the anolyte system (the compartment 205, the reservoir 225 and the connecting plumbing) is an "open loop" system because the anolyte volume within the system can change; specifically, the anolyte volume in the reservoir 225 can change. Closed loop systems are also possible.

A pump 227 draws the anolyte from the reservoir 225 through an anolyte entry line 229 into the anode chamber 205. In some embodiments, flow is directed over the anode surface to facilitate mixing. Anolyte from chamber 205 may be recycled back to the reservoir 225 via an anolyte exit line 231. The temperature and composition of the anolyte may be controlled within the reservoir 225. In some embodiments, the concentration of copper ions in the anode chamber 205 may be limited so that it does not reach saturation. When copper ions are produced at the anode and when hydrogen ions are used to carry substantial current across the porous membrane (as a supporting electrolyte), the concentration of copper ions within the anode chamber can increase to a high level and cause precipitation. Thus, there may be a need to introduce fresh dilute solution from the reservoir 225 into the chamber 205.

In some embodiments, catholyte needs periodic dosing of anolyte to maintain desired levels of chemical concentrations. In some embodiments, the apparatus includes an anolyte-catholyte exchange line 235 and an exchange pump 233 for introducing anolyte into catholyte. In the embodiment shown in FIG. 1, the exchange line 235 draws anolyte from the anolyte reservoir 225. In other embodiments not shown here, the exchange line 235 may draw anolyte directly from the anode chamber 205. In some embodiments, the exchange line 235 may conversely introduce catholyte into anolyte.

Further embodiments of flow loops for catholyte and anolyte and dosing methods and apparatus are described in U.S. Patent Publication No. 2011/0226614, which is herein incorporated by reference.

Figure 2:
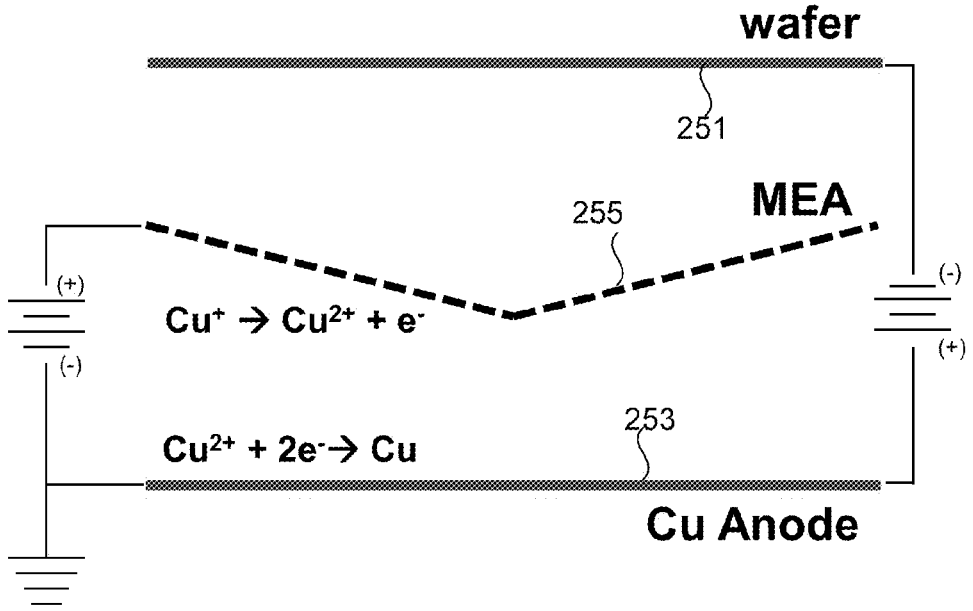
FIG. 2 illustrates an example of a configuration of an electroplating apparatus including a carbon anode that can be used to remove Cu(I) from the anolyte electrochemically.

Some embodiments disclosed herein control reactive metal cations by electrochemically oxidizing Cu(I) to Cu(II). FIG. 2 shows an example of a configuration of an electroplating apparatus including a carbon anode that can be used to remove Cu(I) from the anolyte electrochemically. Shown in FIG. 2 are a copper anode 253 (which would be in an anode chamber) and a wafer substrate 251 (which would be in a catholyte or plating chamber). The anode chamber and the cathode chamber are separated by a membrane electrode assembly (MEA) 255. The membrane electrode assembly 255 includes an ionic membrane, as described above with respect to FIG. 1. The membrane electrode 255 assembly also includes a carbon cloth on the side of the ionic membrane facing the copper anode (i.e., in the anode chamber).

In some embodiments, the carbon cloth is a woven carbon fiber cloth. In some embodiments, the carbon cloth may include a glassy carbon fiber. In some embodiments, the carbon cloth may be similar to a carbon cloth that is used in some types of fuel cells. In some embodiments, the carbon cloth may be mechanically robust (e.g., not generate carbon particles in the anolyte) and have enough porosity such that a liquid may pass through it. In some embodiments, the carbon cloth may have a thickness of about 50 microns to 1 millimeter (mm). In some embodiments, the carbon cloth may be coextensive with the ionic membrane; that is, the carbon cloth may underlay the entire surface area of the ionic membrane. With the carbon cloth being coextensive with the ionic membrane, any species that diffuse across the ionic membrane from the anode chamber into the cathode chamber would pass through the carbon cloth.

During an electroplating operation, the carbon cloth may be polarized about 0.25 V to 0.75 V, or about 0.5 V, positive relative to the copper anode 253. The carbon cloth may be polarized at a voltage high enough relative to the copper anode such that Cu(I) is oxidized to Cu(II), but not so high that water is electrolyzed. Cu(II) may pass though the membrane electrode assembly 255, and does not deleteriously react with additives in the catholyte. Polarizing the copper cloth in this manner may prevent Cu(I) from leaking or diffusing through the ionic membrane and entering the cathode chamber. Thus, Cu(I) would remain in the anode chamber and not react with organic additives in the catholyte in the cathode chamber.

In some embodiments of an electroplating apparatus in which a membrane electrode assembly (MEA) is implemented, the anolyte would not be added to the plating solution or catholyte (e.g., to maintain inorganic additive concentrations). Thus, with the membrane electrode assembly preventing Cu(I) from crossing the ionic membrane and entering the catholyte and anolyte not being added to the catholyte, there would be no Cu(I) entering the catholyte and reacting with organic additives in the catholyte.

Figure 3:
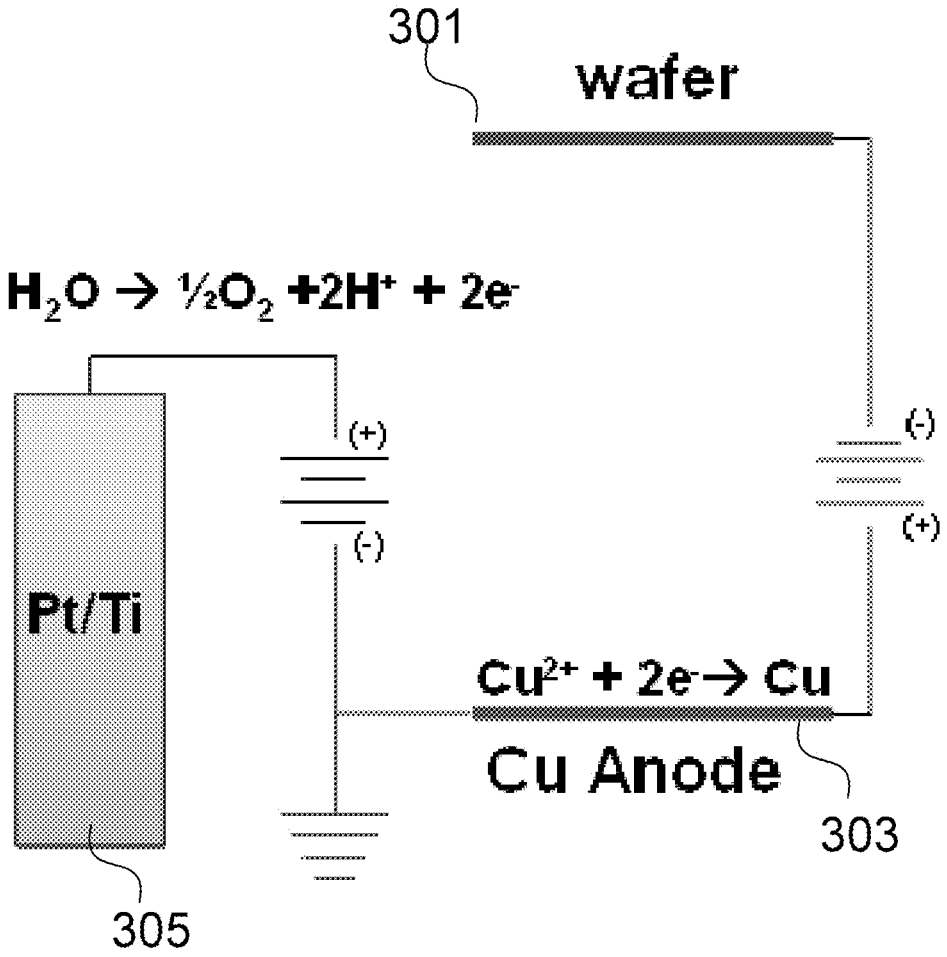
FIG. 3 shows an example of a configuration of an electroplating apparatus that includes an impressed current cathodic protection (ICCP) anode.

FIG. 3 shows an example of a configuration of an electroplating apparatus in some embodiments, which includes a protection anode 305 that can counteract a corrosion reaction at the electroplating copper anode 303 and maintain a high dissolved oxygen concentration in the anolyte. Maintaining a high dissolved oxygen concentration in the anolyte serves to maintain dissolved oxygen as the primary scavenger of Cu(I). Shown in FIG. 3 are a copper electroplating anode 303 (which would be in an anode chamber) and a wafer substrate 301 (which would be in a catholyte or plating chamber). In some embodiments, other suitable materials for the anode can be substituted for electroplating. The anode chamber and the cathode chamber would be separated by an ionic membrane (not shown here). The electroplating apparatus also includes a platinum/titanium (Pt/Ti) anode 305, which is also termed an impressed current cathodic protection anode (ICCP anode). The Pt/Ti electrode is a block or piece of Ti coated with Pt, to increase the surface area of the Pt. Other materials may also be used for an ICCP anode, such as a nickel (Ni) electrode and other metals with a low overpotential to the evolution of oxygen.

During an electroplating operation, current may be passed though the ICCP anode 305 to electrolyze water. The electrolysis of water produces electrons which may combine with Cu(I) or Cu(II), plating copper back onto the copper anode; basically, this is driving a corrosion reaction of the copper anode backward by reducing copper cations to copper (i.e., corrosion/oxidation of the copper anode 303 may produce Cu(I) in and deplete oxygen from the anolyte). The electrolysis of water also produces oxygen, increasing the oxygen concentration of the anolyte.

The amount to current passed through the ICCP anode depends on the size of the electroplating apparatus and on the surface area of the copper anode. The amount of current passed though the ICCP anode also depends on the desired reaction. In some embodiments, the current passed through the ICCP anode may be about 1 μA/cm2 to 100 μA/cm2 with respect to the copper anode for an electroplating process for a 300 mm wafer substrate.

In some embodiments, the corrosion rate of the copper anode may be reduced by supplying a small current to the ICCP anode (in some embodiments, less than about 50 $\mu A/cm^2$ with respect to the copper anode for an electroplating process for a 300 mm wafer substrate). In these embodiments, the electroplating apparatus including the ICCP anode may also include an anolyte oxygenation device which may be used to increase the dissolved oxygen content of the anolyte. Various anolyte oxygenation devices are further described below. Further, in these embodiments, the ICCP anode may increase the lifespan on the copper anode because it would corrode more slowly and may make the copper concentration in the anolyte and the catholyte more controllable.

In some embodiments, the corrosion of the copper anode may be substantially stopped by supplying a moderate current to the ICCP anode (in some embodiments, about 50 μA/cm2 with respect to the copper anode for an electroplating process for a 300 mm wafer substrate), maintaining the oxygen concentration of the anolyte at a specific level. In some embodiments, the corrosion of the copper anode may be stopped and copper may be plated onto the anode by supplying a higher current to the ICCP anode (in some embodiments, greater than about 50 μA/cm2 with respect to the copper anode for an electroplating process for a 300 mm wafer substrate).

In operation, the ICCP anode generates gas bubbles due to the electrolysis of water. In some embodiments, the ICCP anode may be disposed in the anolyte reservoir to preclude any gas bubbles from being generated in the anode chamber due to the ICCP anode. In some other embodiments, the ICCP anode may be disposed in the anode chamber, but away from the ionic membrane to aid in preventing gas bubbles from collecting on the ionic membrane and interfering with the electroplating process. In some embodiments, the ICCP anode is in contact with the anolyte somewhere in an anolyte system described with respect to FIG. 1.

In some embodiments, a membrane electrode assembly or an impressed current cathodic protection anode may be added to an existing electroplating apparatus. In some embodiments, decreasing the potential degradation of organic additives in the catholyte by Cu(I) may decrease the costs of operating the electroplating apparatus.

Some embodiments disclosed herein control reactive metal cations by oxidizing cations in the electrolyte using passive oxygenation (splashing, torturous path, waterfall, gas-exchange membrane, pooling) or active oxygenation (bubbling/sparging, sweep gas contacting, pressurization contacting) of the anolyte. Sources of oxygen for oxygenation of the anolyte include atmospheric air, clean dry air (CDA), and substantially pure oxygen.

In some embodiments, a dwell tank that is fluidly coupled with the anode chamber may be included as part of the electroplating apparatus. In some embodiments, the anolyte reservoir 225 may function as a dwell tank. Anolyte from the anode chamber may remain in the dwell tank for a time that is sufficient to allow oxygenation of the anolyte and conversion of Cu(I) in the anolyte to cupric (Cu(II)) ions. In these embodiments, however, Cu(I) is still formed in the anode chamber and may potentially cross the cationic membrane separating the anode chamber and the cathode chamber and enter the catholyte. Cu(II) is not reactive with the organic additives and is already present in the catholyte at high concentrations. Converting the Cu(I) to Cu(II) through oxygenation in this manner before the closed loop anolyte solution is dosed into the catholyte may address the issues described above. In some embodiments, increasing the anolyte dissolved oxygen concentration from 0.2 ppm to greater than 1 ppm may be sufficient to convert Cu(I) to Cu(II).

Figure 4:
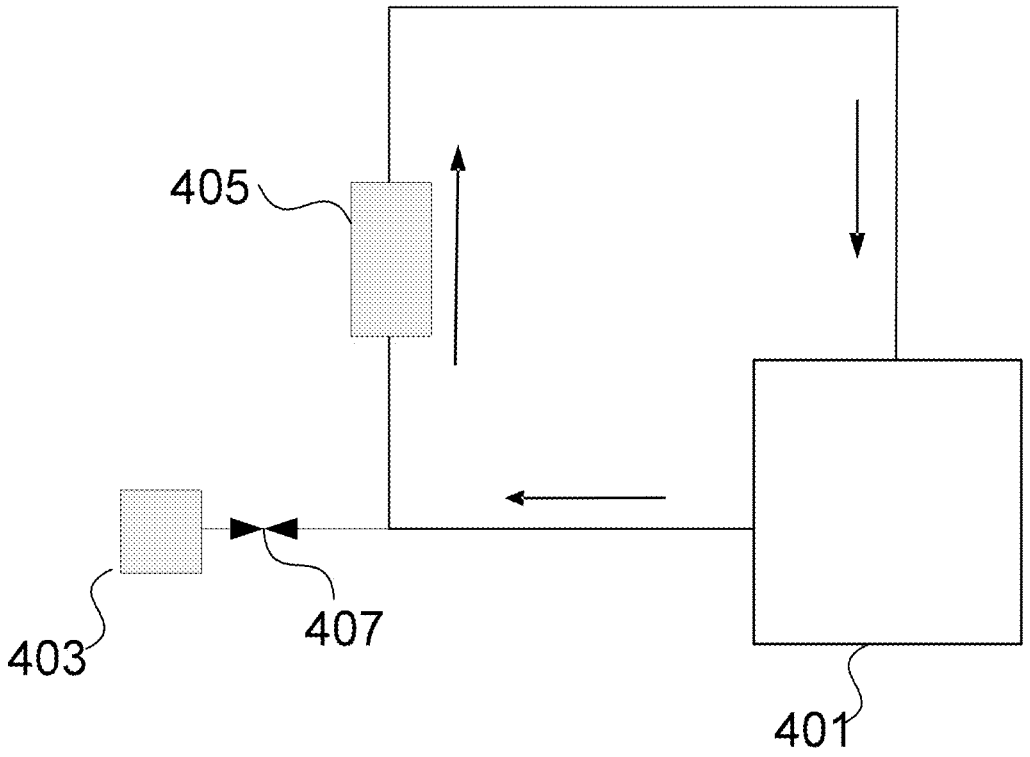
FIG. 4 shows a block diagram of an anode chamber, a dwell tank, and a pump, as part of an electroplating apparatus.

FIG. 4 shows an example of a block diagram of an anode chamber 401, a dwell tank 403, and a pump 405. The dwell tank may be isolated from a flow loop of the anolyte by a valve 407. Anolyte may remain in the dwell tank for a period of time until the oxygen concentration reaches a desired level, and then may be reintroduced back into the anode chamber.

Different methods may be used to oxygenate the anolyte in the dwell tank 403. In some embodiments, the dwell tank 403 is sized such that it can hold anolyte for greater than about 1 hour and allow oxygenation by diffusion of oxygen in ambient air into the anolyte. In some embodiments, the dwell tank 403 may include integrated mixing/stirring of the anolyte with an air system including a pump that may increase the diffusion of oxygen into the solution. In some embodiments, a mixing system may include pouring the anolyte through air over a series of steps. In some embodiments, the mixing system may include a fluid pump/magnetic stir system.

In some embodiments, a circulation pump and/or oxygenation device may be included with a dwell tank (not shown in FIG. 4). The circulation pump may force solution through an oxygen sparging device that is connected to the dwell tank and an inlet of clean dry air. In some embodiments, the oxygen sparging device may be located in the dwell tank and produce small micro-bubbles of air in the solution. In some embodiments, small bubbles of air introduced into the anolyte may quickly increase the oxygen concentration in the solution and convert Cu(I) to Cu(II). In some embodiments, a pump and/or oxygen sparging device may be used in place of a dwell tank if the sparing device is capable of oxygenating the anolyte solution rapidly before it is dosed to the catholyte. In embodiments involving dosing, the anolyte may be introduced to the catholyte through a line such as the exchange line 235 shown in FIG. 1.

In some embodiments, the oxygen concentration of the anolyte in the anode chamber may be increased through the use of an oxygenation device that is placed in-line with the separated anode chamber recirculation pump. The oxygenation device may produce bubbles or microbubbles of air or other gas including oxygen within the anolyte as it is circulated by the pump through the anode chamber. In these embodiments, the formation of Cu(I) is prevented and thus Cu(I) cannot potentially cross the cationic membrane and enter the catholyte in the cathode chamber.

A test performed with such an oxygenation device on an electroplating apparatus rapidly increased the anolyte oxygen content from about 0.2 ppm to 8 ppm and maintained the oxygen concentration at a high level that did not allow Cu(I) to substantially accumulate in the anolyte solution. In some embodiments, using this device may make it possible to control and adjust the oxygen concentration within the separated anode chamber.

Figure 5:
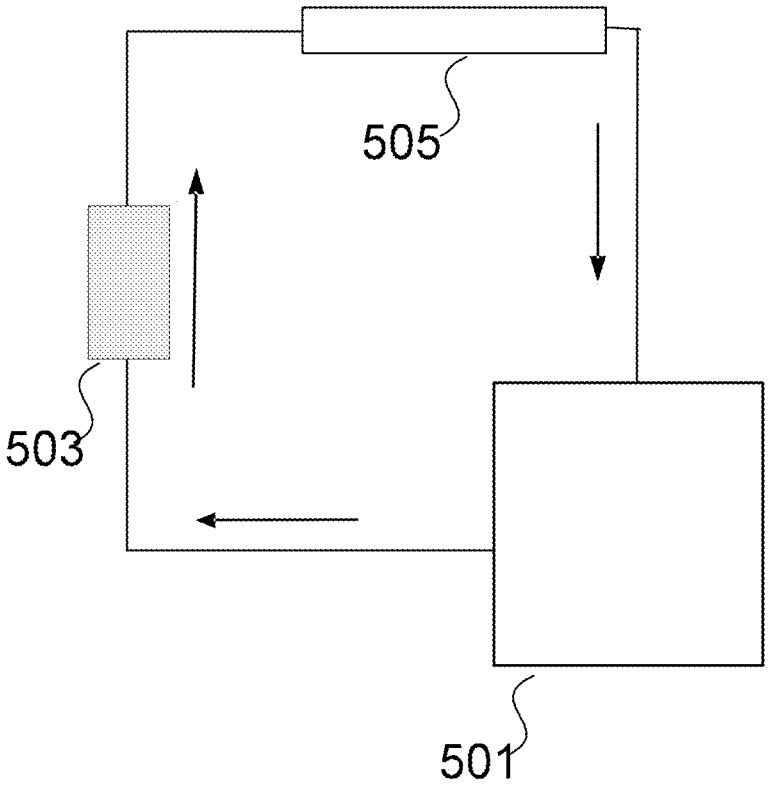
FIG. 5 shows a block diagram of an anode chamber, a pump, and an oxygenation device, as part of an electroplating apparatus.

FIG. 5 shows an example of a block diagram of an anode chamber 501, a pump 503, and an oxygenation device 505. During an electroplating operation, the anolyte may be circulated in the flow loop though the oxygenation device 505 to increase the oxygen concentration of the anolyte. In some embodiments, an oxygenation device is not included and the anolyte is oxygenated by introducing oxygen to the anolyte in a component in the flow loop already present. For example, air or another gas including oxygen could be bubbled through the anolyte in a holding tank or other component of the flow loop.

In some embodiments, the oxygenation device may be a contactor or a membrane contactor. Examples of commercially available oxygenation devices include the Liqui-Cel® Membrane Contactors and the SuperPhobic® Contactors from Membrana (Charlotte, N.C.) and the pHasor™ from Entegris (Chaska, Minn.). The oxygenation device may add oxygen to the anolyte to an extent determined by, for example, the anolyte flow rate, the exposed area and nature of semi-permeable membrane across which a gas is applied to the oxygenation device, and the pressure of the applied gas. Typical membranes used in such devices allow the flow of molecular gasses but do not permit the flow of liquids or solutions which cannot wet the membrane.

In some embodiments, the oxygen concentration of the anolyte in the anode chamber may be controlled to be at or close to a specified concentration using feedback from an oxygen concentration meter. For example, an apparatus may include an in-line oxygenation device as described above with respect to FIG. 5 that is associated with the anode chamber and an oxygen concentration meter. The oxygen concentration meter may provide a real-time oxygen concentration reading to a controller. The controller may use this reading to control the source of oxygen (e.g., air, CDA, or substantially pure oxygen) to the oxygenating device to adjust the amount of oxygen added to the anolyte. Such an apparatus may allow for specific oxygen concentrations of the anolyte to be controlled within desired ranges during an electroplating process.

For example, in a TSV fabrication process, the flow rate of an anolyte in a flow loop may be about 0.25 liters per minute (lpm) to about 1 lpm, or about 0.5 lpm. The anolyte flowing out of the anolyte chamber, before passing though the oxygenation device, may have an oxygen content of about 1 ppm or greater than about 1 ppm. After the anolyte passes through the oxygenation device, the anolyte may have an oxygen content of about 2 ppm, 5 ppm, or 8.8 ppm. Thus, the oxygen content of the anolyte may be 1 ppm or greater when the anolyte is in the anode chamber or in the flow loop.

In some embodiments, the surface area of the copper anode may be specified such that the Cu(II) concentration in the anolyte may be about 60 grams per liter (g/L). If the surface area of the copper anode is large (for example, when using spheres of copper for the anode as opposed to using a flat copper anode), the Cu(II) concentration in the anolyte may be about 65 to 75 g/L.

In some embodiments, the temperature of the anolyte may be about 20° C. to 35° C., or about 23° C. to 30° C. With higher temperatures, the corrosion rate of the anode may increase when oxygen is added to the anolyte. With higher temperatures, more oxygen needs to be dissolved into the anolyte due to the reaction kinetics of the copper corrosion at the anode, which may consume dissolved oxygen in the anolyte more rapidly. Lower temperatures in the anolyte chamber (i.e., 23° C. to 30° C.) may reduce the corrosion rate of the anode.

In some embodiments, an apparatus or device for increasing the oxygen concentration in the anolyte may be added to an existing electroplating apparatus. In some embodiments, decreasing the potential degradation of organic additives in the catholyte by Cu(I) may decrease the costs of operating the electroplating apparatus.

In some embodiments, a suitable apparatus for accomplishing the methods described herein includes hardware for accomplishing the process operations and a system controller having instructions for controlling process operations in accordance with the disclosed embodiments. Hardware for accomplishing the process operations includes electroplating apparatus. In some embodiments, a system controller (which may include one or more physical or logical controllers) controls some or all of the operations of a process tool. The system controller will typically include one or more memory devices and one or more processors. The processor may include a central processing unit (CPU) or computer, analog and/or digital input/output connections, stepper motor controller boards, and other like components. Instructions for implementing appropriate control operations are executed on the processor. These instructions may be stored on the memory devices associated with the controller or they may be provided over a network. In certain embodiments, the system controller executes system control software.

The system control logic may include instructions for controlling the timing, mixture of electrolyte components, inlet pressure, plating cell pressure, plating cell temperature, wafer temperature, current and potential applied to the wafer and any other electrodes, wafer position, wafer rotation, oxygen level sensor, oxygen and/or electrolyte flow rate, and other parameters of a particular process performed by the process tool.

System control logic may be configured in any suitable way. In general, the logic used to control electroplating apparatus can be designed or configured in hardware and/or software. In other words, the instructions for controlling the drive circuitry may be hard coded or provided as software. In may be said that the instructions are provided by "programming." Such programming is understood to include logic of any form including hard coded logic in digital signal processors and other devices which have specific algorithms implemented as hardware. Programming is also understood to include software or firmware instructions that may be executed on a general purpose processor. System control software may be coded in any suitable computer readable programming language.

Various process tool component subroutines or control objects may be written to control operation of the process tool components necessary to carry out various process tool processes. In some embodiments, system control software includes input/output control (IOC) sequencing instructions for controlling the various parameters described herein. For example, each phase of an electroplating process may include one or more instructions for execution by the system controller. The instructions for setting process conditions for an immersion process phase may be included in a corresponding immersion recipe phase. In some embodiments, the electroplating recipe phases may be sequentially arranged, so that all instructions for an electroplating process phase are executed concurrently with that process phase.

Other logic implemented as, for example, software programs and routines may be employed in some embodiments. Examples of programs or sections of programs for this purpose include a substrate positioning program, an electrolyte composition control program, a pressure control program, a heater control program, an oxygen sensor feedback control program, and a potential/current power supply control program.

In some embodiments, there may be a user interface associated with the system controller. The user interface may include a display screen, graphical software displays of the apparatus and/or process conditions, and user input devices such as pointing devices, keyboards, touch screens, microphones, etc.

In some embodiments, parameters adjusted or affected by the system controller may relate to process conditions. Non-limiting examples include oxygen concentration of electrolyte, copper cations concentration of electrolyte, voltage and current for electrodes (e.g. electroplating electrodes, ICCP anode, and carbon anode of MEA), electrolyte flow rate, pH values, electrolyte temperature, etc. These parameters may be provided to the user in the form of a recipe, which may be entered utilizing the user interface.

Signals for monitoring the process may be provided by analog and/or digital input connections of the system controller from various process tool sensors. The signals for controlling the process may be output on the analog and digital output connections of the process tool. Non-limiting examples of process tool sensors that may be monitored include mass flow controllers, pH sensors, pressure sensors (such as manometers), thermocouples, etc. Appropriately programmed feedback and control algorithms may be used with data from these sensors to maintain process conditions.

The apparatus/process described hereinabove may be used in conjunction with lithographic patterning tools or processes, for example, for the fabrication or manufacture of semiconductor devices, displays, LEDs, photovoltaic panels and the like. Typically, though not necessarily, such tools/processes will be used or conducted together in a common fabrication facility.

It is to be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated may be performed in the sequence illustrated, in other sequences, in parallel, or in some cases omitted. Likewise, the order of the above-described processes may be changed.

III. METHOD

Another aspect of the invention relates to methods for electroplating a metal onto a wafer substrate. In some embodiments, the method involves providing an anolyte in an anode chamber having an anode and being separated from a cathode chamber by a porous transport barrier that enables migration of ionic species, including metal cations, across the transport barrier while substantially blocking organic plating additives from diffusing across the transport barrier. The method also involves providing a catholyte to the cathode chamber containing the substrate attached to a cathode electrical connection, wherein the catholyte contains a substantially greater concentration of the organic plating additives than the anolyte. The method further includes oxidizing cations of the metal to be electroplated onto the substrate, which cations are present in the anolyte during electroplating. The method involves applying a potential difference between the substrate and the anode, thereby plating the metal onto the substrate without substantially increasing the concentration of plating additives in the anolyte.

In some embodiments, the metal to be electroplated onto the substrate is copper, the anolyte comprises one or more copper salts dissolved in a solvent. The oxidation of metal cations is achieved by oxidizing Cu(I) to Cu(II).

Figure 6:
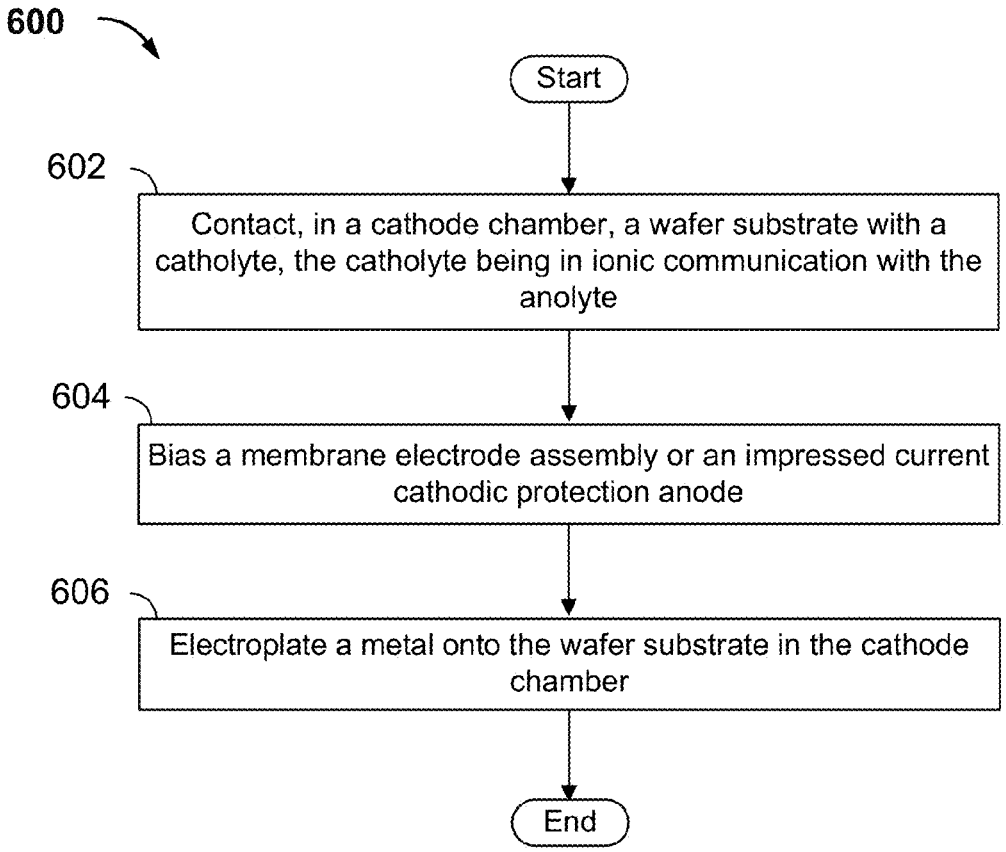
FIG. 6 shows a flow diagram of a method of electroplating a metal onto a wafer substrate.

FIG. 6 shows an example of a method of electroplating a metal onto a wafer substrate. At block 602, a wafer substrate is contacted with a catholyte in a cathode chamber. The catholyte is in ionic communication with the anolyte, the anolyte being in contact with the anode in the anolyte chamber. At block 604, a membrane electrode assembly (MEA) or an impressed current cathodic protection anode (ICCP anode) as described above is biased. At block 606, a metal is electroplated onto the wafer substrate in the cathode chamber.

Figure 7:
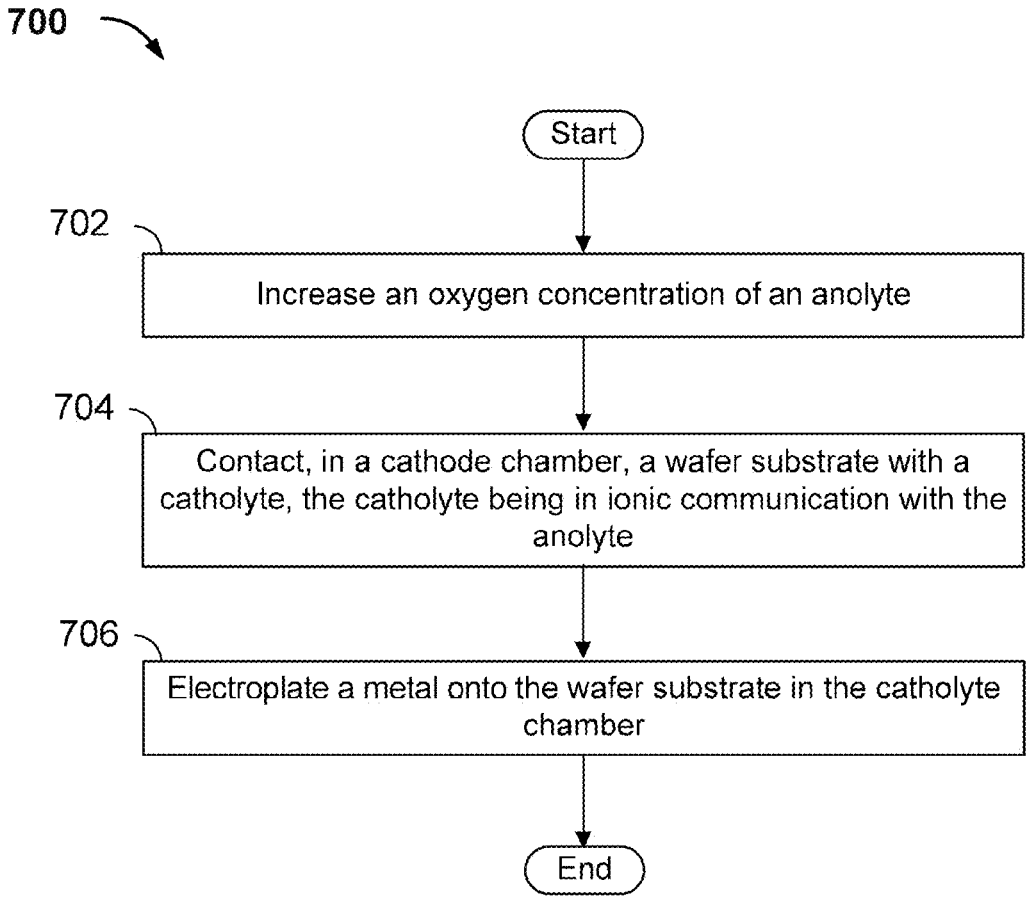
FIG. 7 shows a flow diagram of an alternative method of electroplating a metal onto a wafer substrate.

FIG. 7 shows an example of a method of electroplating a metal onto a wafer substrate. At block 702 of the method 700, the oxygen concentration of the anolyte is increased. The anolyte is in contact with an anode. In some embodiments, the oxygen concentration of the anolyte is increased to about 0.05 ppm to 8.8 ppm oxygen, to about 0.5 ppm to 2 ppm oxygen, or to about 1 ppm oxygen.

At block 704, a wafer substrate is contacted with a catholyte in a cathode chamber. The catholyte is in ionic communication with the anolyte. At block 706, a metal is electroplated onto the wafer substrate in the cathode chamber.

Embodiments disclosed herein also may provide benefits in through silicon via (TSV) fabrication apparatus and processes, including increases in the TSV plating solution lifetime. The apparatus/process described hereinabove may be used in conjunction with lithographic patterning tools or processes, for example, for the fabrication or manufacture of semiconductor devices, displays, LEDs, photovoltaic panels and the like. Typically, though not necessarily, such tools/ processes will be used or conducted together in a common fabrication facility. Lithographic patterning of a film typically comprises some or all of the following steps, each step enabled with a number of possible tools: (1) application of photoresist on a work piece, i.e., substrate, using a spin-on or spray-on tool; (2) curing of photoresist using a hot plate or furnace or UV curing tool; (3) exposing the photoresist to visible, UV, or x-ray light with a tool such as a wafer stepper; (4) developing the resist so as to selectively remove resist and thereby pattern it using a tool such as a wet bench; (5) transferring the resist pattern into an underlying film or work piece by using a dry or plasma-assisted etching tool; and (6) removing the resist using a tool such as an RF or microwave plasma resist stripper.

It should be noted that there are many alternative ways of implementing the disclosed methods and apparatuses. It is therefore intended that the disclosed embodiments be interpreted as including all such alterations, modifications, permutations, and substitute equivalents as fall within the true spirit and scope of this disclosure.

IV. EXPERIMENTS

Figure 10A:
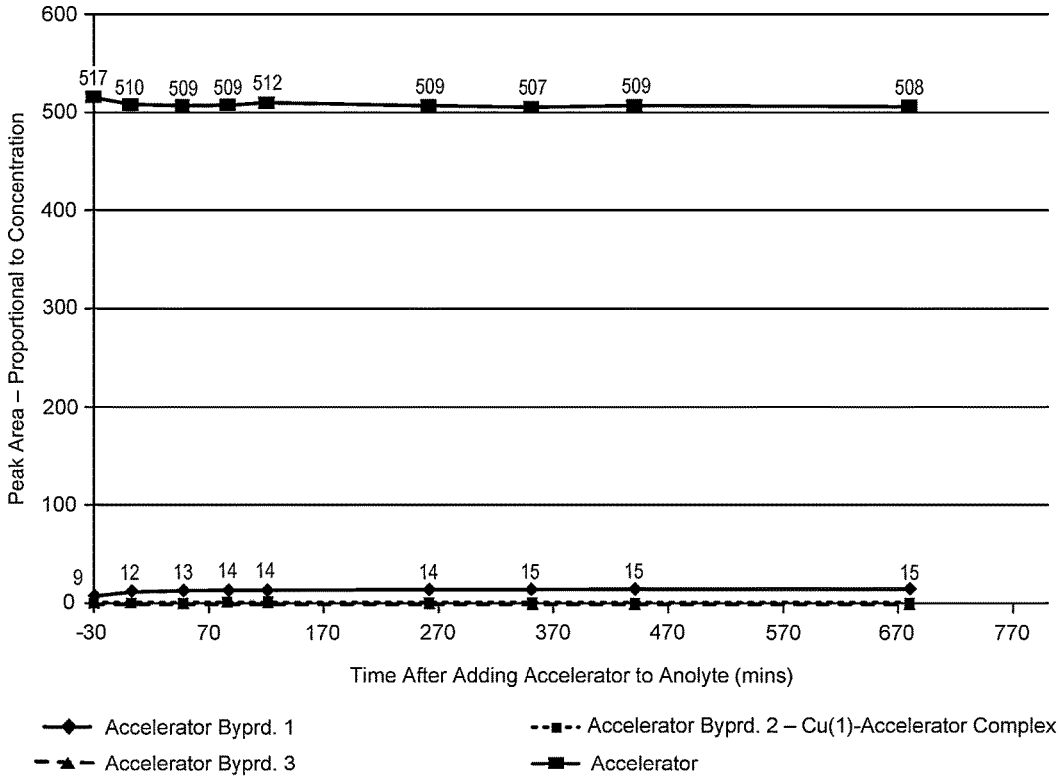
FIGS. 10A and 10B show a comparison of accelerator degradation behavior observed in solutions that do not contain Cu(I) (FIG. 10A) and those that do contain Cu(I) (FIG. 10B)
Figure 10B:
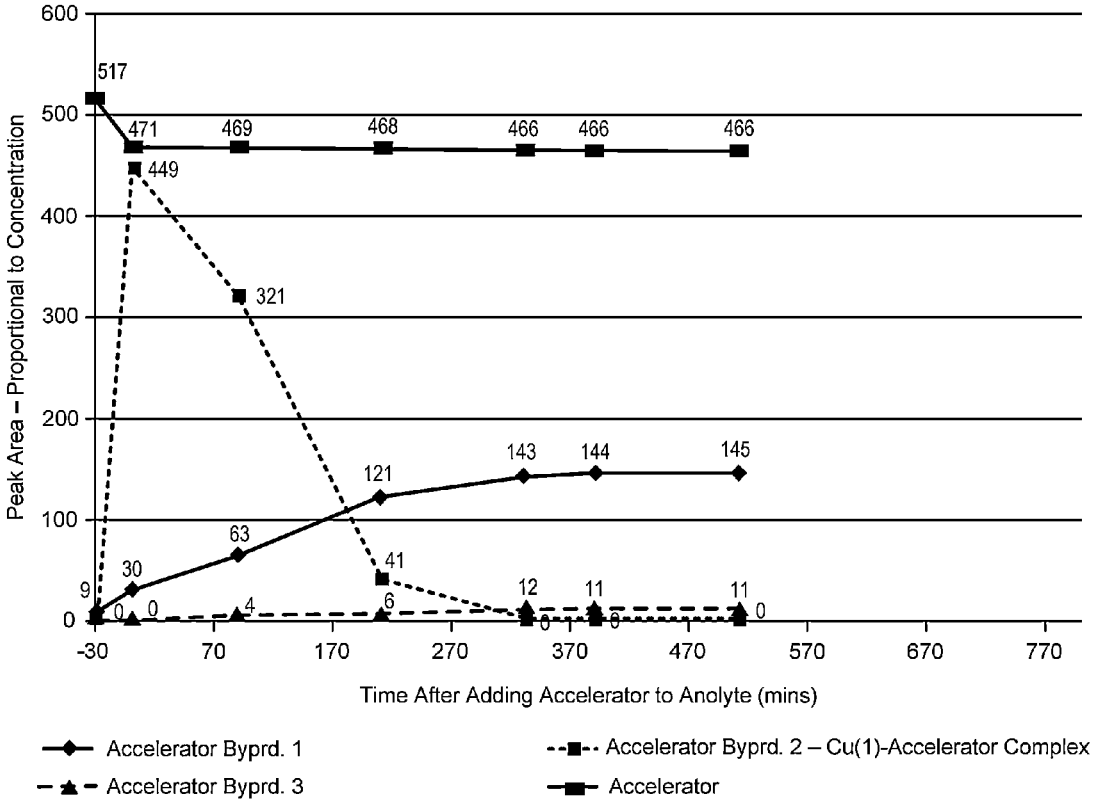
Figure 11:
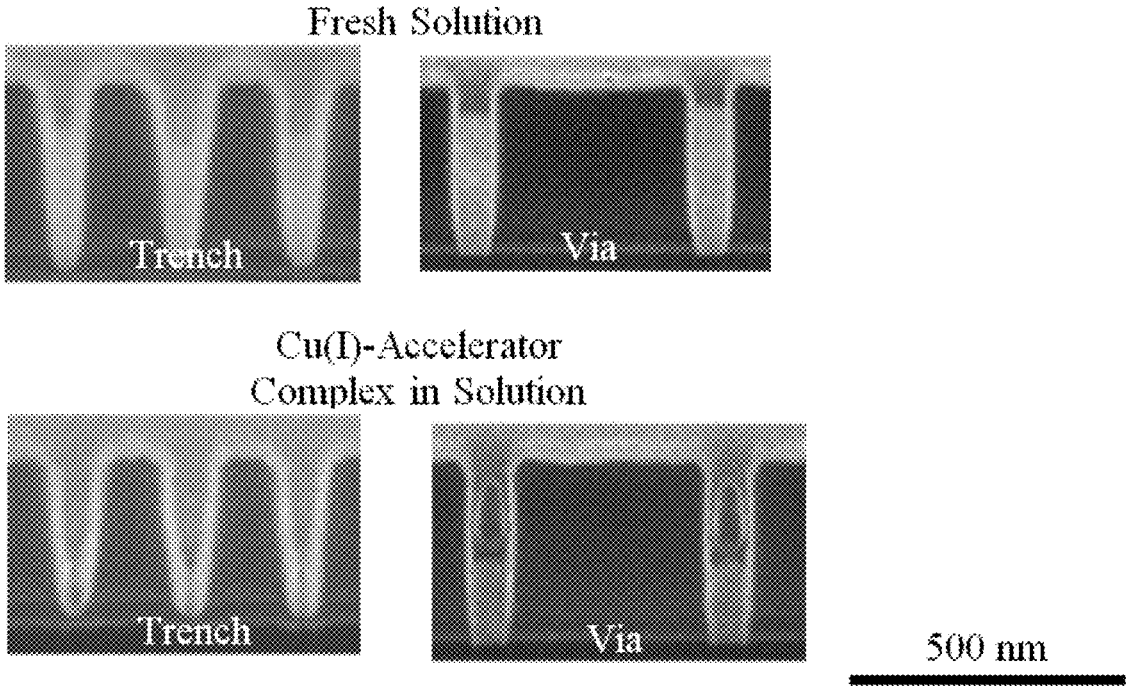
FIG. 11 shows that the Cu(I)-accelerator complex present in a plating solution can significantly reduce the fill rate seen in trenches and vias in a wafer substrate.
Figure 12:
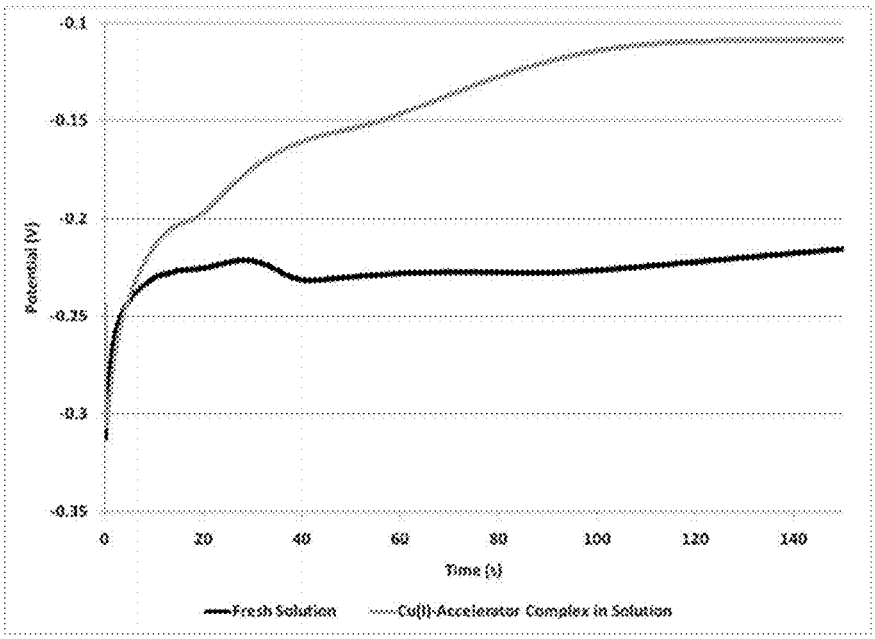
FIG. 12 shows the impact of Cu(I)-accelerator complexes in the catholyte on the electrochemical copper deposition.
Figure 13:
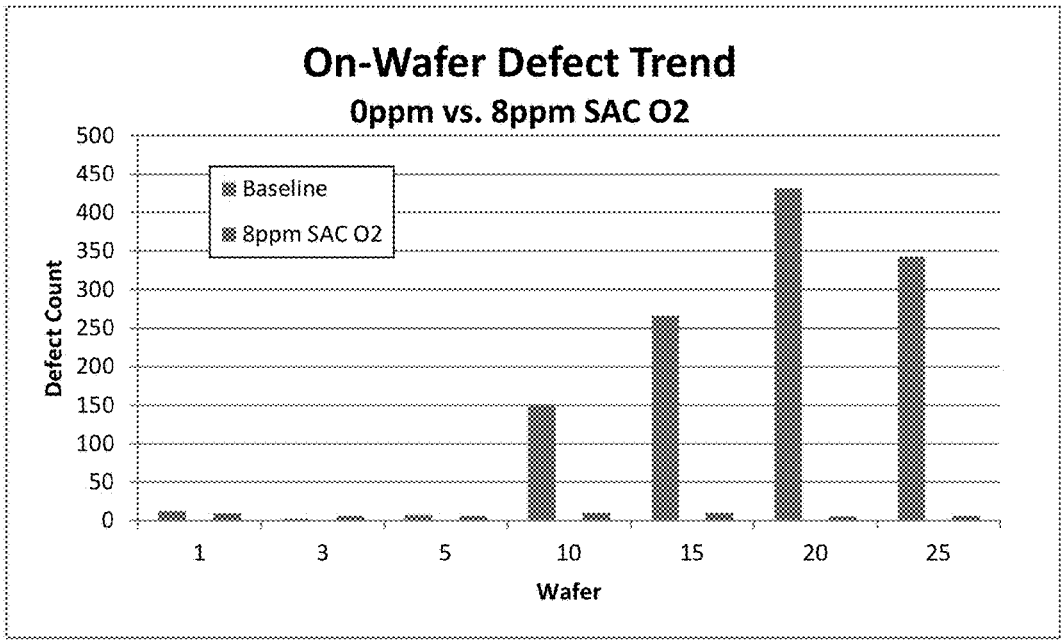
FIG. 13 shows that increasing the oxygen concentration in the anode chamber of the electroplating apparatus decreases the number of defects in wafer substrates as wafer substrates are cycled through the electroplating apparatus.
Figure 14:
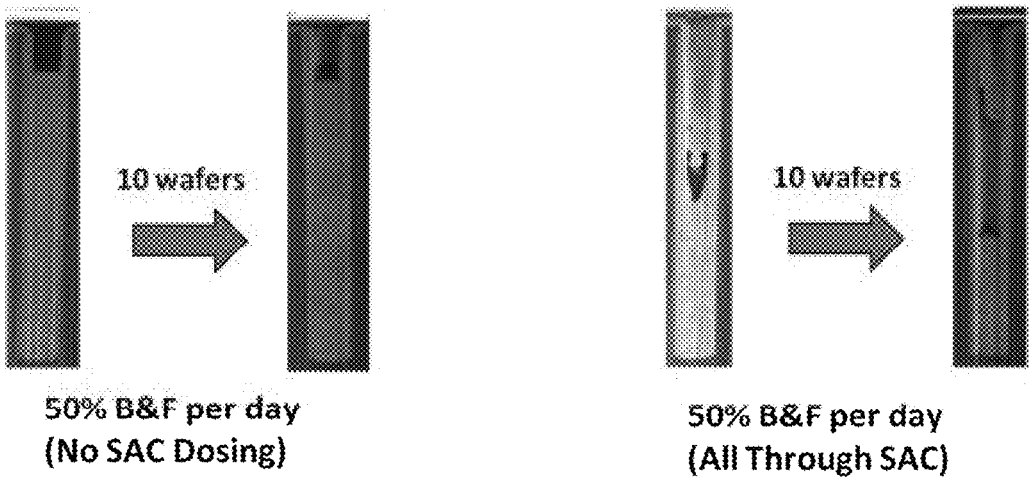
FIG. 14 shows that adding anolyte having a low dissolved oxygen content from the anode chamber to the plating solution degrades TSV fill performance.
Figure 15:
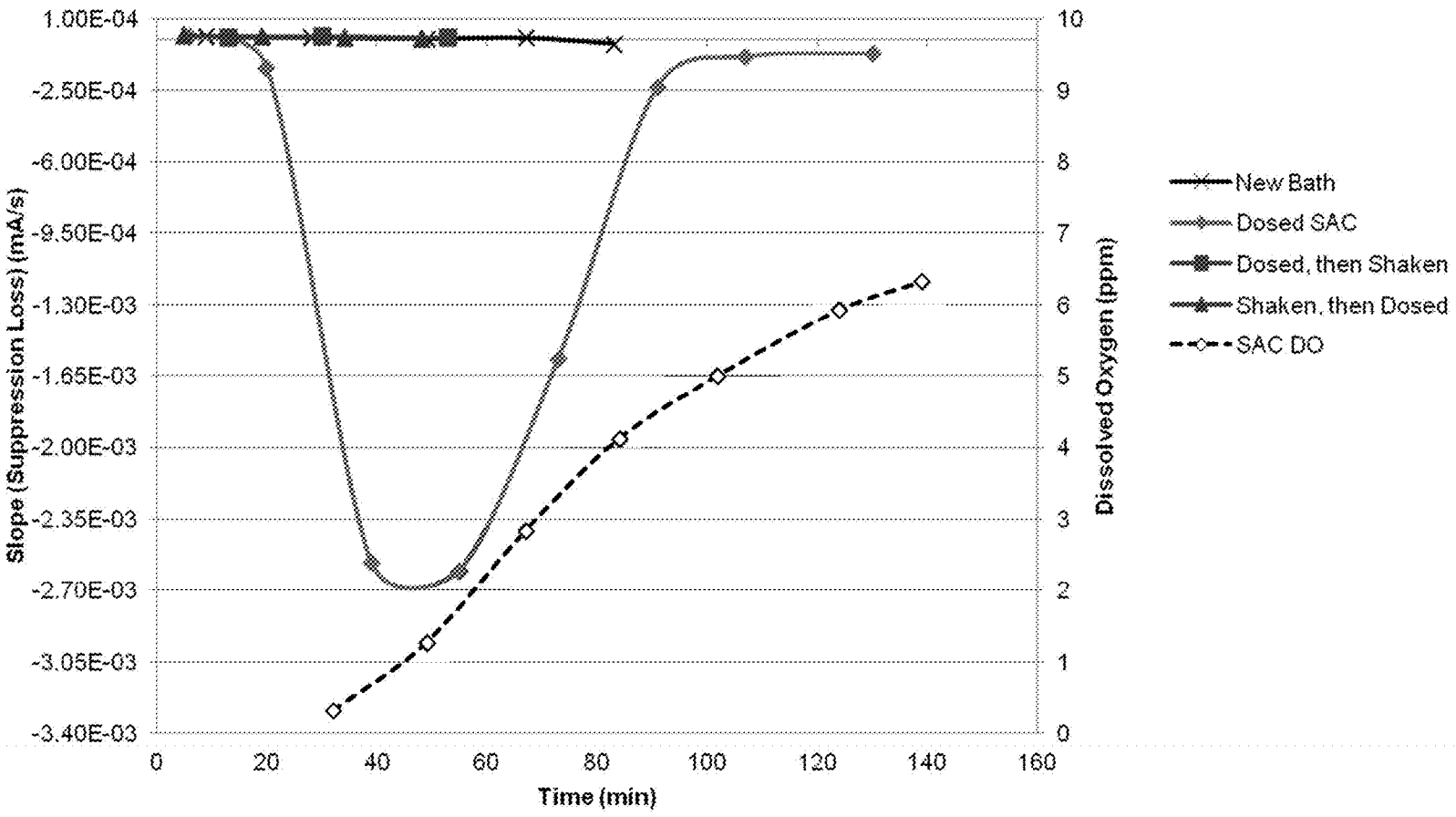
FIG. 15 shows electrochemical data illustrating the impact on TSV additives dosed into anolyte from the anode chamber.
Figure 16:
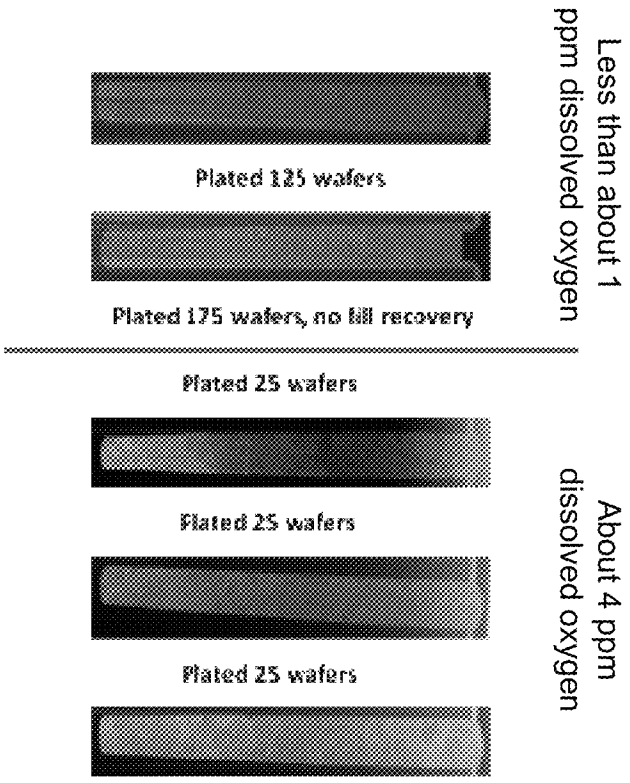
FIG. 16 shows that increasing the anolyte dissolved oxygen level from less than about 1 ppm to about 4 ppm leads to recovery of degraded TSV fill.

Shown below are the results of experiments performed to study of the possible impact of Cu(I) in the anolyte solution on accelerator degradation in Damascene and TSV processes (FIGS. 8-16). FIGS. 11-13 show the results of experiments performed with Damascene processes. In Damascene processing, one effect of Cu(I) forming in the anolyte is a larger number of defects in the wafer substrates. FIGS. 14-16 show the results of experiments performed with TSV processes. In TSV processes, one effect of Cu(I) in the anolyte is a decrease in the fill rate.

Figure 8:
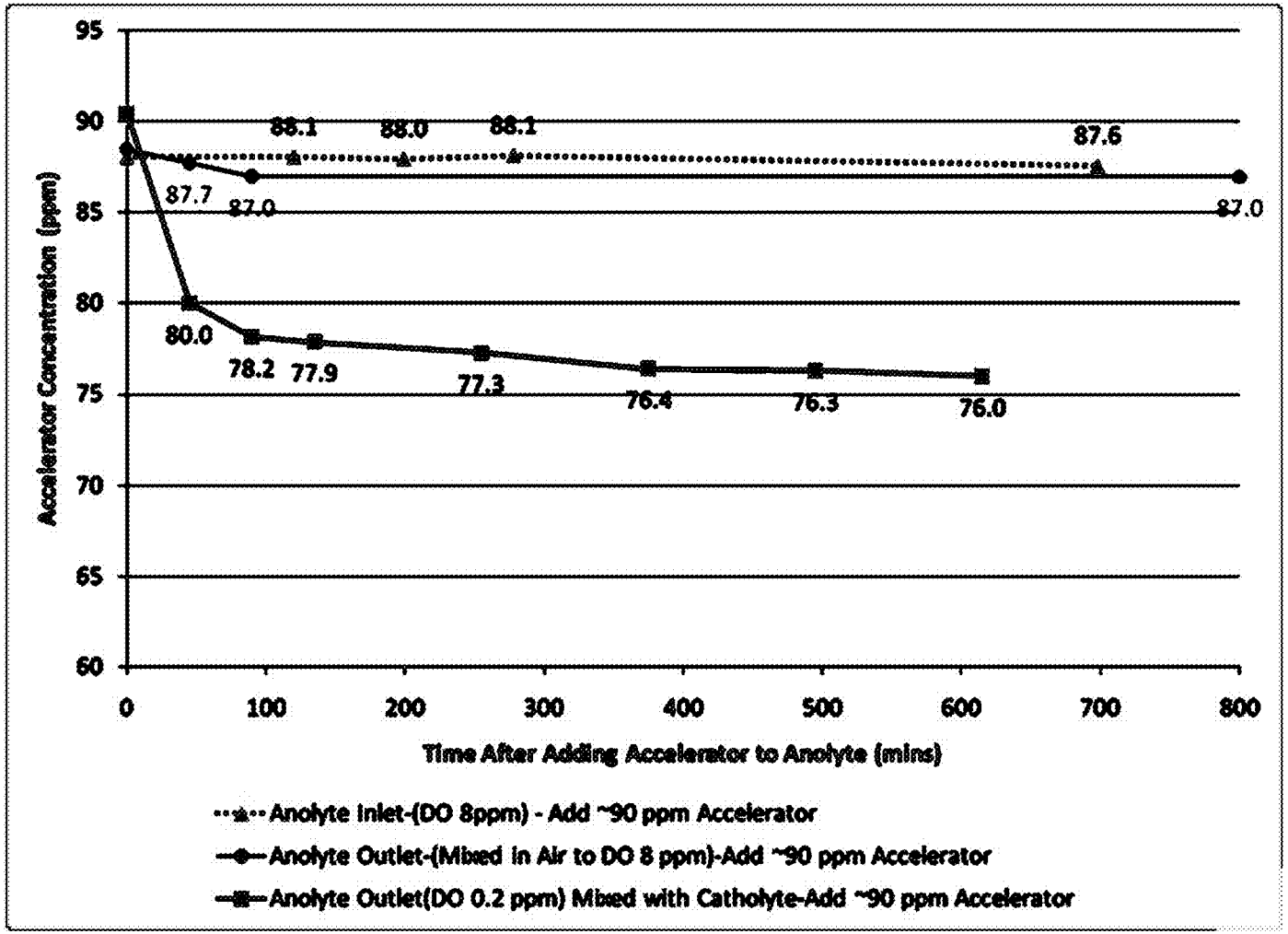
FIG. 8 shows data illustrating the potential degradation impact of mixing anolyte including Cu(I) with the catholyte.

FIG. 8 shows data illustrating the potential degradation impact of mixing anolyte including Cu(I) with the catholyte. Cu(I) generated in the anode chamber can degrade accelerator molecules if the anolyte is not first mixed with air to increase the dissolved oxygen concentration present in the anolyte. FIG. 8 shows that a fresh anolyte (i.e., anolyte inlet) does not contain Cu(I) that cause accelerator degradation in the catholyte. Thus, this reactive species is generated in the anode chamber through interactions of the anolyte and the copper anode. Data in FIG. 8 also shows that anolyte, if mixed in air to a dissolved oxygen content of 8 ppm oxygen, also does not contain a reactive Cu(I) species that causes accelerator degradation. This data indicates that Cu(I) can be converted back to Cu(II) after exposure to oxygen and will not cause accelerator degradation. The third set of data shown in FIG. 8 illustrates that anolyte (dissolved oxygen content of 0.2 ppm) taken directly from the anode chamber that is mixed with catholyte is seen to cause rapid degradation of accelerator molecules due to interactions with Cu(I).

Figure 9:
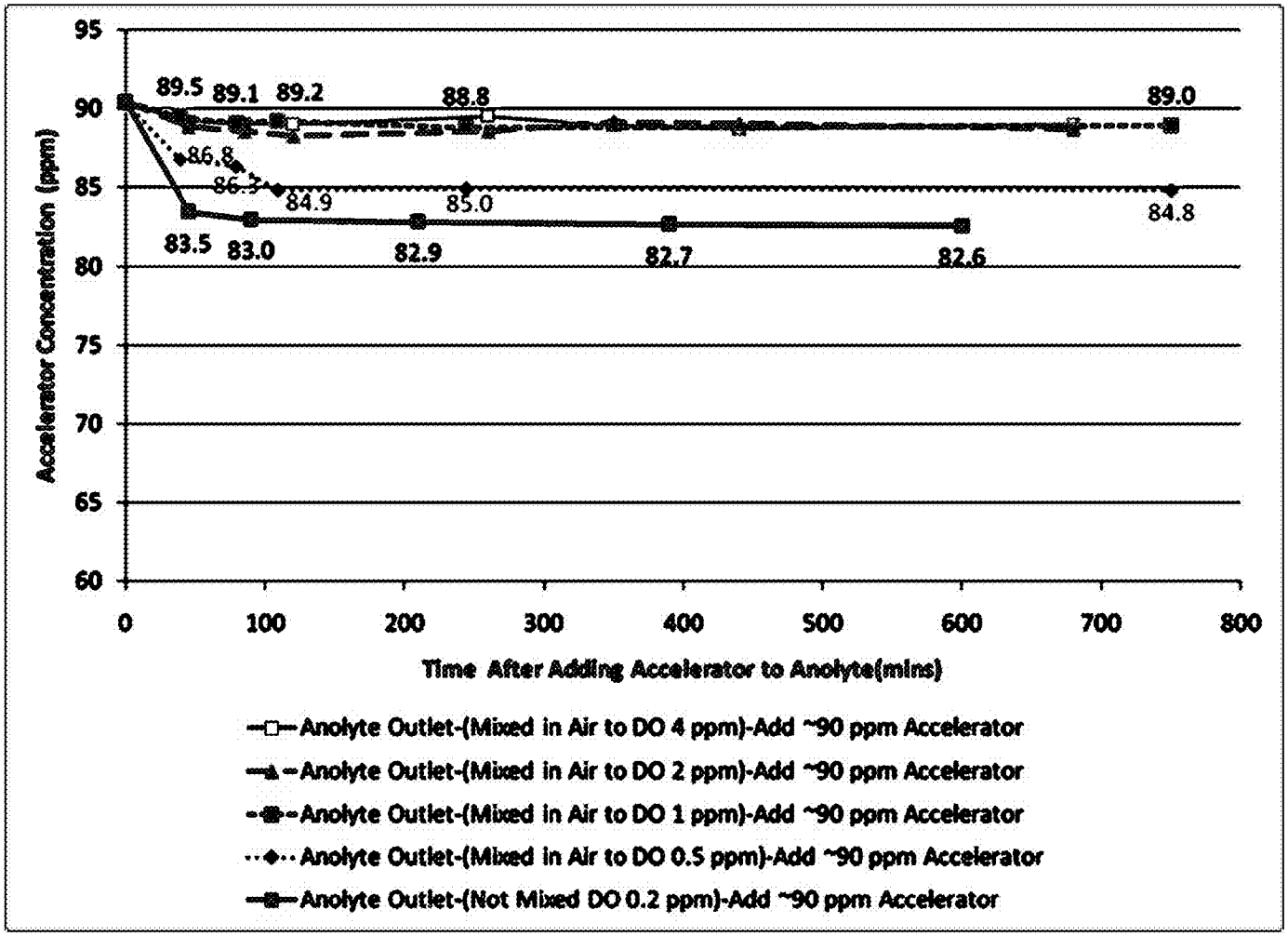
FIG. 9 shows the results of an experiment that was performed to determine the amount of dissolved oxygen necessary to have in solution in the anolyte to convert Cu(I) to Cu(II) and to diminish accelerator degradation.

FIG. 9 shows the results of an experiment that was performed to determine the amount of dissolved oxygen necessary to have in solution in the anolyte to convert Cu(I) to Cu(II) and to diminish accelerator degradation. FIG. 9 shows data illustrating that increasing the dissolved oxygen concentration of the anolyte to about 1 ppm or greater will remove accelerator degradation effects related to Cu(I).

FIGS. 10A and 10B show a comparison of accelerator degradation behavior observed in solutions that do not contain Cu(I) (FIG. 10A) and those that do contain Cu(I) (FIG. 10B). FIG. 10B illustrates that accelerator molecules are degraded into an air sensitive complex species that then can degrade into two additional byproducts by Cu(I) in solution. Accelerator is not degraded into these byproducts if it is mixed into an anolyte solution that was first mixed with air to a dissolved oxygen concentration above 1 ppm.

FIG. 11 shows that the Cu(I)-accelerator complex present in a plating solution can significantly reduce the fill rate seen in trenches and vias in a wafer substrate. Cu(I)-accelerator byproduct formation was confirmed through experiments similar to those used to produce the data shown in FIGS. 10A and 10B.

FIG. 12 shows the impact of Cu(I)-accelerator complexes in the catholyte on the electrochemical copper deposition. Cu(I)-accelerator byproduct formation was confirmed through experiments similar to those used to produce the data shown in FIGS. 10A and 10B. Galvanostatic data plot clearly shows that the catholyte with Cu(I)-accelerator complexes is more depolarized than the fresh catholyte, which may decrease the fill rate.

FIG. 13 shows that increasing the oxygen concentration in the anode chamber of the electroplating apparatus decreases the number of defects in wafer substrates as wafer substrates are cycled through the electroplating apparatus. FIG. 13 shows that the defect counts on wafers electroplated without anolyte oxygenation increase to >100 within 10 wafers. When the anolyte is oxygenated, the defects remain <10. Cu(I) transport across the membrane interacts with accelerator species per Reaction 3 (above) and potentially with other species in the catholyte. When the oxygen level in the anolyte in the anode chamber is increased (to 8 ppm, in this case) the defects are eliminated.

FIG. 14 shows that adding anolyte having a low dissolved oxygen content from the anode chamber to the plating solution (micrographs on the right hand side) degrades 10 micron by 100 micron TSV fill performance compared to adding electrolyte having a high dissolved oxygen content (not from the anode chamber) to the plating solution (micrographs on the left hand side). B&F refers to the addition of electrolyte which does not include organic additives. Note that fill is degraded even on the initial wafer when anolyte is added to the catholyte in the cathode chamber.

FIG. 15 shows electrochemical data illustrating the impact on TSV additives dosed into anolyte from the anode chamber. The large negative slope values are taken from the rate of depolarization (or suppression loss) of a chronoamperometry experiment and correlate with poor TSV fill performance. As the dissolved oxygen level of the depolarized sample increases above 1 ppm, polarization recovers. Samples shaken (i.e., samples shaken in a flask to dissolve oxygen in the anolyte) to rapidly increase the dissolved oxygen level prior to analysis do not show a polarization loss.

FIG. 16 shows that increasing the anolyte dissolved oxygen level from less than about 1 ppm to about 4 ppm leads to recovery of degraded TSV fill.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for electroplating a metal onto a substrate, the apparatus comprising:

(a) an electroplating cell comprising:

a cathode chamber for containing catholyte during electroplating;

a cathode electrical connection in the cathode chamber, the cathode electrical connection being able to connect to the substrate and apply a potential allowing the substrate to become a cathode;

an anode chamber for containing anolyte during electroplating;

an anode electrical connection in the anode chamber, the anode electrical connection being able to connect to an electroplating anode and apply a potential to the electroplating anode; and a porous transport barrier placed between the anode chamber and the cathode chamber, which transport barrier enables migration of ionic species in an electrolyte, including metal cations, across the transport barrier while substantially preventing organic additives from passing across the transport barrier;

(b) at least one oxygenation device (OGD) configured to oxidize cations of the metal to be electroplated onto the substrate, which cations are present in the anolyte during electroplating; and (c) an oxygen concentration meter configured to measure oxygen concentration in the anolyte.

2. The apparatus of claim 1, wherein the metal to be electroplated onto the substrate is copper, the anolyte comprises one or more copper salts dissolved in a solvent, and the oxygenation device (OGD) oxidizes Cu(I) to Cu(II).

3. The apparatus of claim 2, wherein the catholyte contains a substantially greater concentration of the organic plating additives than the anolyte does.

4. The apparatus of claim 2, wherein the porous transport barrier comprises a material selected from the group consisting of porous glasses, porous ceramics, silica areogels, organic aerogels, porous polymeric materials, and filter membranes.

5. The apparatus of claim 2, further comprising an anolyte recirculation loop fluidically coupled to the electroplating cell, wherein the anolyte recirculation loop comprises an anolyte storage reservoir connected to the anode chamber, and an anolyte recirculation pump that recirculates anolyte to the anode chamber.

6. The apparatus of claim 5, wherein the oxygenation device (OGD) is disposed in the anolyte recirculation loop and exposes anolyte in the anolyte recirculation loop to oxygen.

7. The apparatus of claim 6, wherein the OGD is placed in line with the anolyte recirculation pump.

8. The apparatus of claim 6, wherein the OGD comprises a dwell tank fluidly coupled to the anode chamber.

9. The apparatus of claim 6, wherein the OGD comprises an oxygen sparging device disposed in the anolyte storage reservoir.

10. The apparatus of claim 6, wherein the OGD comprises a contactor or a membrane contactor.

11. The apparatus of claim 6, wherein the anolyte recirculation loop is configured to operate with a flow rate at about 0.25 liters per minute (lpm) to about 1 lpm.

12. The apparatus of claim 6, wherein a source of oxygen for the OGD is selected from the group consisting of atmospheric air, clean dry air, substantially pure oxygen, and combinations thereof.

13. The apparatus of claim 6, wherein the oxygen concentration meter provides a real-time oxygen concentration reading to a controller that is configured for controlling an oxygen concentration in the anolyte within a desired range during an electroplating process.

14. The apparatus of claim 1, further comprising a catholyte storage reservoir connected to the cathode chamber to provide a catholyte to the cathode chamber.

15. The apparatus of claim 1, wherein the apparatus further comprises:

(d) a controller configured to operate the OGD so as to increase a dissolved oxygen concentration of the anolyte to greater than 0.05 parts per million (PPM) but no more than 4 PPM.

16. The apparatus of claim 15, wherein the controller is configured to operate the OGD to increase a dissolved oxygen concentration of the anolyte to greater than 0.05 PPM but no more than 2 PPM.

17. The apparatus of claim 15, wherein the controller is configured to operate the OGD to increase a dissolved oxygen concentration of the anolyte to greater than 0.5 PPM but no more than 4 PPM.

18. The apparatus of claim 15, wherein the controller is configured to operate the OGD to increase a dissolved oxygen concentration of the anolyte to greater than 0.5 PPM but no more than 2 PPM.

19. The apparatus of claim 15, wherein the controller is configured to operate the OGD to increase a dissolved oxygen concentration of the anolyte to greater than 0.05 PPM but no more than 1 PPM.

* * * * *